US010850520B2

(12) United States Patent
Yamada et al.

(10) Patent No.: US 10,850,520 B2
(45) Date of Patent: Dec. 1, 2020

(54) RECORDING DEVICE

(71) Applicant: SEIKO EPSON CORPORATION, Tokyo (JP)

(72) Inventors: Katsumi Yamada, Matsumoto (JP); Kazunori Takabayashi, Okaya (JP); Morio Iwata, Matsumoto (JP); Keisuke Sasaki, Matsumoto (JP); Satoshi Nakata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/360,661

(22) Filed: Mar. 21, 2019

(65) Prior Publication Data

US 2019/0291445 A1 Sep. 26, 2019

(30) Foreign Application Priority Data

Mar. 23, 2018 (JP) ..... 2018-056526

(51) Int. Cl.
*B41J 2/175* (2006.01)
*B41J 25/00* (2006.01)

(52) U.S. Cl.
CPC ..... *B41J 2/17506* (2013.01); *B41J 25/006* (2013.01)

(58) Field of Classification Search
CPC .. B41J 2/17506; B41J 25/006; B41J 2/17509; B41J 29/13; B41J 29/02
See application file for complete search history.

(56) References Cited

U.S. PATENT DOCUMENTS 6,250,739 B1 * 6/2001 Serra ..... B41J 2/2132 347/41
2015/0360476 A1 12/2015 Osakabe et al.
2015/0363675 A1 12/2015 Sakamoto
2016/0089893 A1 3/2016 Osakabe et al.
2017/0246871 A1 8/2017 Nakata et al.
2018/0178567 A1 6/2018 Takabayashi

FOREIGN PATENT DOCUMENTS

JP 2006-224433 A 8/2006
JP 2016-000493 A 1/2016
JP 2016-000504 A 1/2016
JP 2016-000505 A 1/2016
JP 2016-068473 A 5/2016
JP 2017-154480 A 9/2017
JP 2018-103526 A 7/2018

* cited by examiner

*Primary Examiner* — Sharon A. Polk
(74) *Attorney, Agent, or Firm* — Workman Nydegger

(57) ABSTRACT

A recording device includes a recording unit configured to eject a liquid onto a medium to record, a carriage including the recording unit and configured to move in an X direction corresponding to a medium width direction that intersects a Y direction corresponding to a medium transport direction, a liquid reservoir located in the carriage at a position above the recording unit, configured to contain a liquid, and having a fill port through which the liquid is supplied, a fill port unit located in the carriage at a position above the liquid reservoir and including a component for open/close operation of the fill port, and an operation unit through which the device is operated. The fill port unit and the operation unit partly overlap in a device front-rear direction that is parallel to the medium transport direction, when viewed in the X direction.

7 Claims, 22 Drawing Sheets

RECORDING DEVICE

BACKGROUND

1. Technical Field

The present invention relates to a recording device that records on a medium.

2. Related Art

An example of a recording device that ejects a liquid onto a medium to record is an ink jet printer. An example of the ink jet printer including a recording head that ejects ink, which is one example of a liquid, and a carriage that moves in a predetermined direction is a serial ink jet printer. Some ink jet printers include ink reservoirs, which contain ink, in the carriages, and others include the ink reservoirs outside the carriages. Examples of the ink reservoir mounted in the carriage include a cartridge ink reservoir, which is entirely replaceable, and a refillable ink reservoir, which is capable of being filled again, as described in JP-A-2006-224433.

In the configuration described in JP-A-2006-224433, an ink supplying needle is inserted into an ink fill port to supply ink to the ink reservoir. The ink fill port is closed with a label and the label is removed when ink is supplied through the ink fill port. The adhesiveness of the label decreases with the duration of use, and thus the label may lose the ability to properly seal the ink fill port. To solve the problem, a mechanical component, such as an openable cap, may be used to open and close the ink fill port. However, the mechanical component increases the overall size of the carriage, making the recording device larger. In particular, a movement area of the carriage is usually adjacent to an operation portion through which the recording device is instructed to perform various tasks. If the position of the operation portion is changed due to the increase in the size of the carriage, the size of the recording device increases accordingly.

SUMMARY

An advantage of some aspects of the invention is that, in a recording device including a refillable liquid reservoir in a carriage, reliable opening and closing of a fill port for liquid refilling and a less increase in size of the recording device are both achieved.

A recording device according to a first aspect of the invention includes a recording unit configured to eject a liquid onto a medium to record, a carriage including the recording unit at a bottom thereof and configured to move in an X direction corresponding to a medium width direction that intersects a Y direction corresponding to a medium transport direction in which a medium is transported while the recording unit is recording, a liquid reservoir located in the carriage at a position above the recording unit, configured to contain a liquid, and having a fill port through which the liquid is supplied, a fill port unit located in the carriage at a position above the liquid reservoir and including a component for open/close operation of the fill port, and an operation unit through which the device is operated. The fill port unit and the operation unit partly overlap in a vertical direction when viewed in the X direction.

According to the aspect, in the recording device including the liquid reservoir that holds a liquid supplied through the fill port in the carriage, the fill port unit including a component for open/close operation of the fill port is disposed.

With this configuration, the fill port is reliably closed. Furthermore, the fill port unit and the operation unit partly overlap in the vertical direction when viewed in the X direction corresponding to the medium width direction that interests the Y direction corresponding to the medium transport direction in which a medium is transported during the recording. This configuration reduces the size of the device in the vertical direction, preventing the size of the device from increasing in the vertical direction.

The recording device according to a second aspect of the invention includes a recording unit configured to eject a liquid onto a medium to record, a carriage including the recording unit at a bottom thereof and configured to move in an X direction corresponding to a medium width direction that intersects a Y direction corresponding to a medium transport direction in which a medium is transported while the recording unit is recording, a liquid reservoir located in the carriage at a position above the recording unit, configured to contain a liquid, and having a fill port through which the liquid is supplied, a fill port unit located in the carriage at a position above the liquid reservoir and including a component for open/close operation of the fill port, and an operation unit through which the device is operated. The fill port unit and the operation unit partly overlap in a device front-rear direction that is parallel to the medium transport direction, when viewed in the X direction.

According to the aspect, the liquid reservoir in the carriage has the fill port for liquid refilling, and the device includes the fill port unit including a component for open/close operation of the fill port. With this configuration, the fill port is reliably closed. Furthermore, the fill port unit and the operation unit partly overlap in the device front-rear direction, which is parallel to the medium transport direction, when viewed in the X direction that intersects the Y direction corresponding to the medium transport direction in which a medium is transported during the recording. This configuration reduces the size of the device in the device front-rear direction, preventing the size of the device from increasing.

In the above-described recording device, the fill port unit may include a pivotable lever-like member having a cap configured to close the fill port and a frame member supporting the lever-like member. The lever-like member is configured to pivot to switch its posture between a closing posture in which the cap closes the fill port and an open posture in which the cap does not close the fill port.

With this configuration, the cap reliably closes the fill port, and the fill port is readily opened or closed because the fill port is opened or closed by the lever-like member.

In the above-described recording device, an overhang configured to cover at least a portion of the lever-like member from above may be disposed at an end portion of a movement area of the carriage adjacent to a home position. The overhang may include a guide portion that guides the lever-like member to a position under the overhang.

In this configuration, the overhang configured to cover at least a portion of the lever-like member from above is disposed at an end portion of the movement area of the carriage adjacent to the home position. Thus, when at least a portion of the lever-like member is located under the overhang, the lever-like member is not unnecessarily operated, i.e., the fill port is not exposed.

If the lever-like member does not completely close the fill port and is in a half-opening posture, for example, the lever-like member comes in contact with the overhang when the carriage moves toward the home position. This may damage the lever-like member or the overhang. To avoid the damage, in this configuration, the overhang has a guide portion that guides the lever-like member to a position under the overhang, and thus the above-describe damage is avoided or reduced.

In the above-described recording device, the frame member may have an upper surface having a plurality of grooves that hold a liquid.

In this configuration, the upper surface of the frame member has grooves that hold a liquid. If the liquid is dropped onto the upper surface of the frame member during the liquid supply through the fill port, the liquid is held in the grooves. This configuration reduces the possibility that the liquid dropped onto the upper surface of the frame member will scatter.

The above-described recording device may further include, at a downstream side of the recording unit in a medium transport route, a discharge driving roller configured to be rotated and a discharge driven roller opposed to the discharge driving roller and configured to be rotated by rotation of the discharge driving roller. The fill port unit and a roller support supporting the discharge driven roller partly overlap in a device front-rear direction that is parallel to the medium transport direction, when viewed in the medium width direction.

In this configuration, the fill port unit and the roller support supporting the discharge driven roller partly overlap in the device front-rear direction that is parallel to the medium transport direction, when viewed in the medium width direction. Thus, the size of the recording device that includes the fill port unit and the roller support supporting the discharge driven roller is reduced in the device front-rear direction.

In the above-described recording device, the roller support may have an upper surface having a guide groove that guides the liquid in a predetermined direction, and a liquid absorber configured to absorb the liquid may be disposed adjacent to an ink guide end of the guide groove.

In this configuration, the upper surface of the roller support has a guide groove that guides the liquid in a predetermined direction and the liquid absorber configured to absorb the liquid is disposed at a liquid guide end of the guide groove. If the liquid is dropped onto the upper surface of the roller support during the liquid supply through the fill port, the liquid is guided by the guide groove to the liquid absorber and absorbed by the liquid absorber. This configuration reduces dirt and damage in the device possibly caused by the liquid.

In the above-described recording device, an overhang configured to cover at least a portion of the lever-like member from above may be disposed at an end portion of a movement area of the carriage adjacent to a home position. The control unit that controls the carriage is configured to execute a carriage stop mode in which the carriage stops at a first position where the lever-like member is located away from the overhang. The lever-like member in a posture other than the closing posture comes in contact with the overhang when the carriage moves from the first position toward a movement limit position adjacent to the home position. The control unit is configured to move the carriage from the first position toward the movement limit position when returns from the carriage stop mode and is configured to determine whether the lever-like member is open or closed based on a position where the carriage stopped.

If the lever-like member is kept opened after the liquid supply to the liquid reservoir, defects such as liquid evaporation and liquid leakage through the fill port may occur. In the above-described configuration, the control unit moves the carriage toward the movement limit position when returns from the carriage stop mode and determines whether the lever-like member is open or closed based on the position where the carriage stopped. The determination on whether the lever-like member is open or closed can eliminate the above defects. In addition, this configuration does not require a separate sensor or the like to determine whether the lever-like member is open or closed, preventing the cost of the device from increasing.

A recording device according to a third aspect of the invention includes a recording unit configured to eject a liquid onto a medium to record, a carriage including the recording unit at a bottom thereof and configured to move in an X direction corresponding to a medium width direction that intersects a Y direction corresponding to a medium transport direction in which a medium is transported while the recording unit is recording, and an operation unit through which the recording device is operated. The carriage and the operation unit partly overlap in a vertical direction or a device front-rear direction that is parallel to the medium transport direction, when viewed in the X direction.

With this configuration, the size of the device including the carriage and the operation unit is reduced in the vertical direction or the device front-rear direction, preventing the size of the device from increasing.

The above-described recording device may further include a liquid reservoir located in the carriage at a position above the recording unit, configured to contain a liquid, and having a fill port through which the liquid is supplied. The fill port and the operation unit overlap in the vertical direction or the device front-rear direction that is parallel to the medium transport direction, when viewed in the X direction.

In this configuration, the fill port and the operation unit partly overlap in the vertical direction or the device front-rear direction that is parallel to the medium transport direction, when viewed in the X direction. Thus, the size of the device is reduced in the vertical direction or the device front-rear direction, preventing the size of the device from increasing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
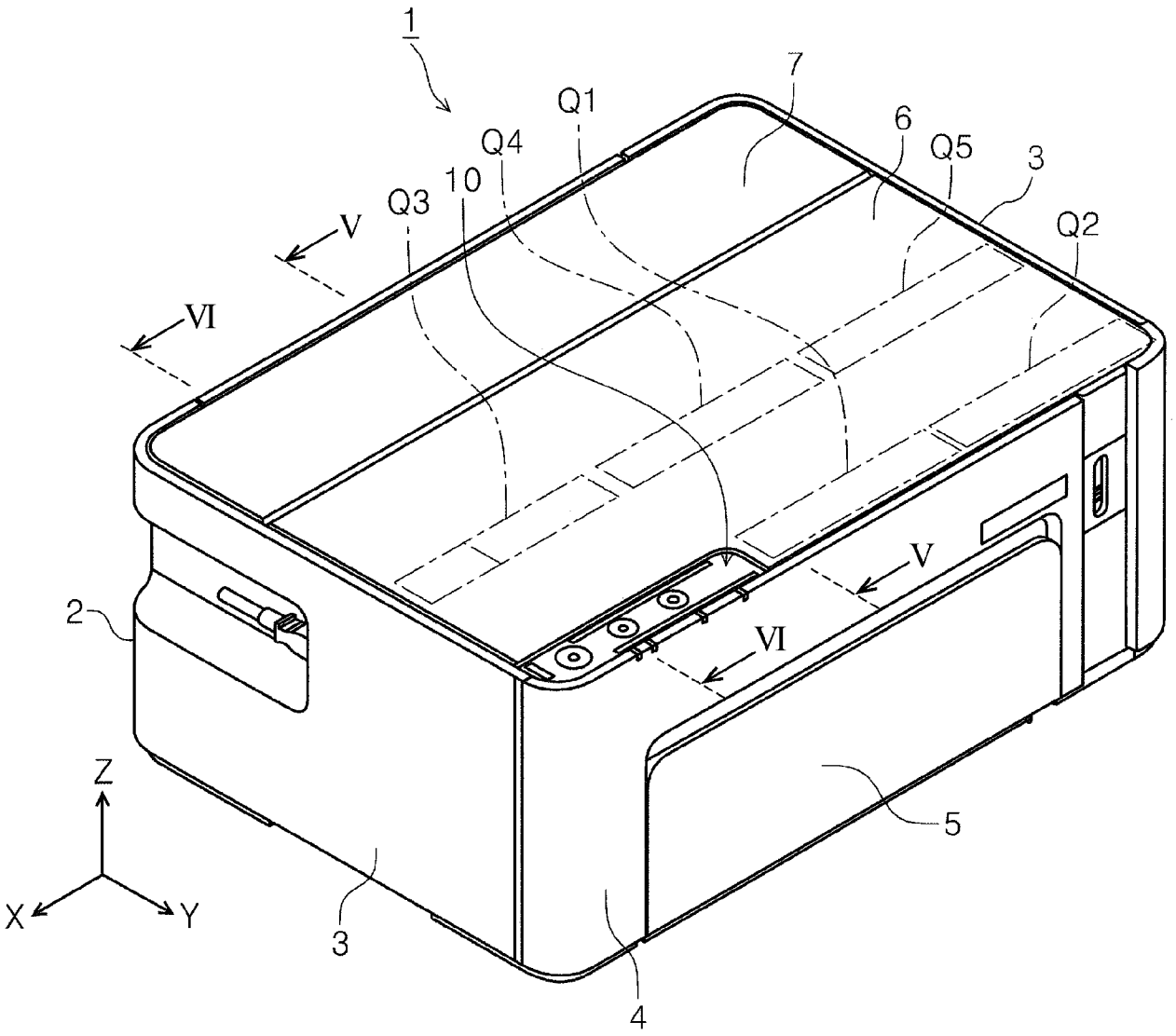
FIG. 1 is a perspective view illustrating an exterior of an ink jet printer according to an embodiment of the invention.

Hereinafter, an embodiment of a recording device according to an aspect of the invention is described with reference to the drawings. In the following description, an ink jet printer (hereinafter, may be referred to as a "printer") 1 that performs ink jet recording on a sheet, which is one example of a medium, is described as an example of the recording device according to an aspect of the invention. The X, Y, and Z coordinate systems are indicated in the drawings such that the X direction indicates a device width direction and a sheet width direction, the Y direction indicates a sheet transport direction and a device front-rear direction, and the Z direction indicates a device height direction and a vertical direction. A side to which a sheet is transported is referred to as a "downstream" side and a side opposite the downstream side is referred to as an "upstream" side.

Hereinafter, the overall configuration of the printer 1 is briefly described with reference to FIGS. 1 to 6. In FIG. 1, the printer 1 includes a device body 2 mainly including a housing 3, a front panel 4, a front cover 5, an upper cover 6, and an upper rear cover 7, which provide an outer frame of the device body 2.

Figure 20:
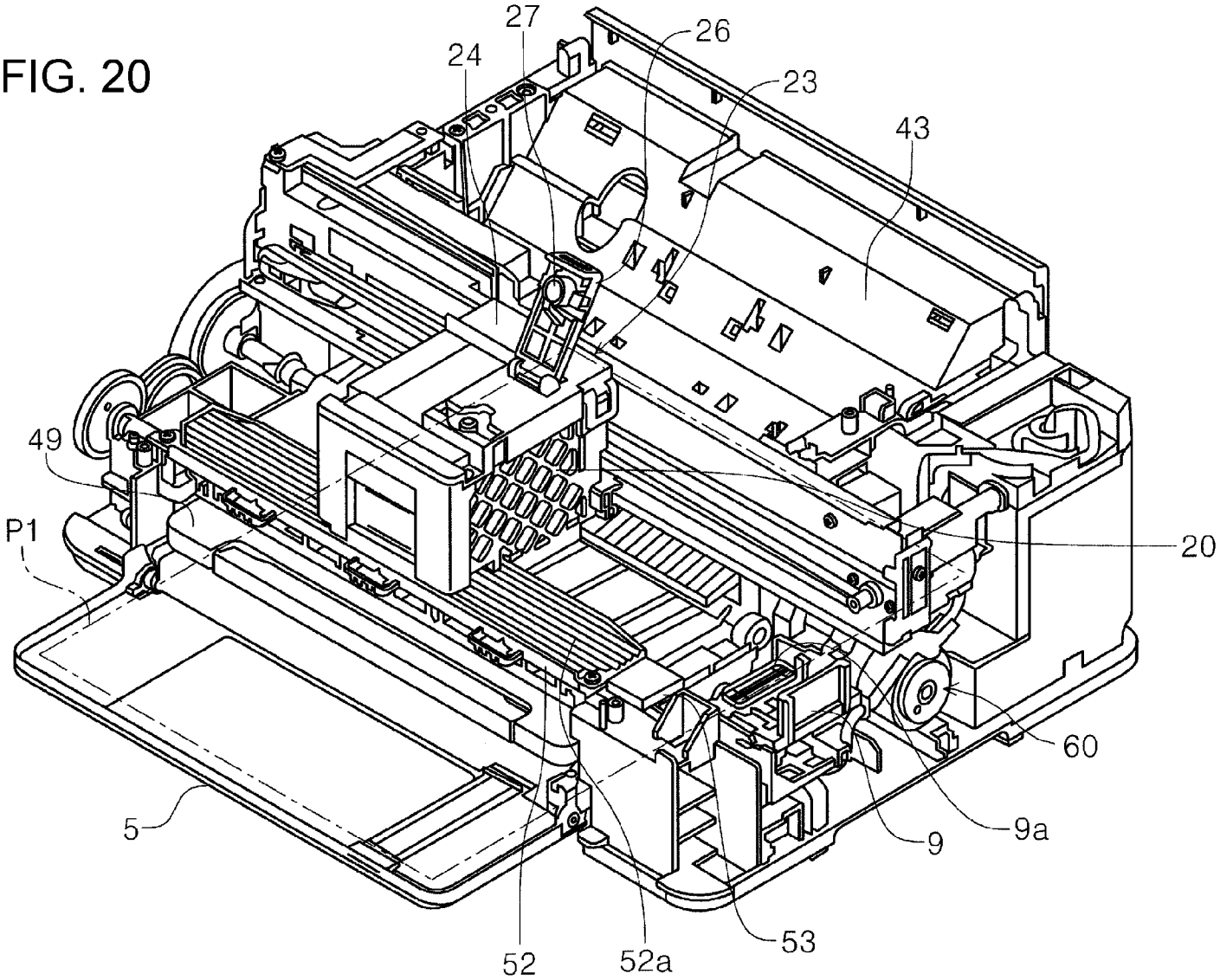
FIG. 20 is a perspective overall view of the device without a housing.

The front cover 5, which provides a front surface of the device, is openable and may be open (FIGS. 1 and 2) and closed (FIG. 20). The open front cover 5 allows a sheet to be supplied into a sheet storage (FIGS. 5 and 6) 40 and allows a recorded sheet to be discharged.

Figure 2:
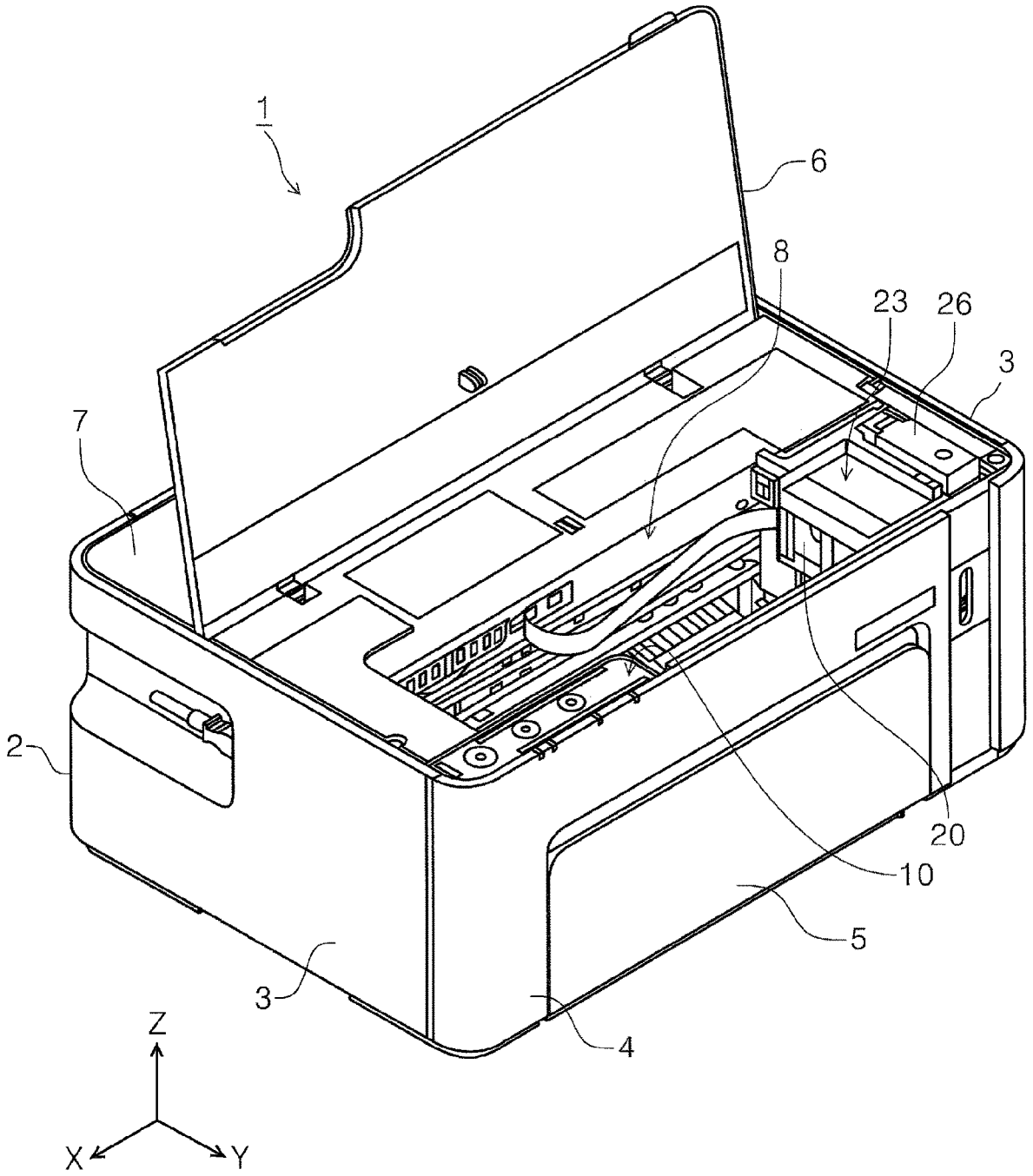
FIG. 2 is a perspective view illustrating an exterior of the ink jet printer according to an embodiment of the invention.

The upper cover 6, which provides a portion of an upper surface of the device, is openable and may be open (FIG. 1) and closed (FIG. 2). The open upper cover 6 allows a carriage movement area 8 to be exposed as illustrated in FIG. 2, enabling operations such as paper jam cleaning and an ink supply operation described below. The upper rear cover 7, which provides an upper surface of the device, is flush with the upper cover 6. In this embodiment, when the device is viewed from the front side, a right end section of the movement area of the carriage 20 is a home position area and a left end section thereof is an opposite area away from the home position area.

An operation unit 10 for giving various instructions to the printer 1 is disposed at a front left portion of the upper surface of the device. Through the operation unit 10, the device is switched on and off and various settings are made. The operation unit 10 is described later further in detail. Areas indicated by Q1 to Q5 in FIG. 1 are also described later.

Figure 5:
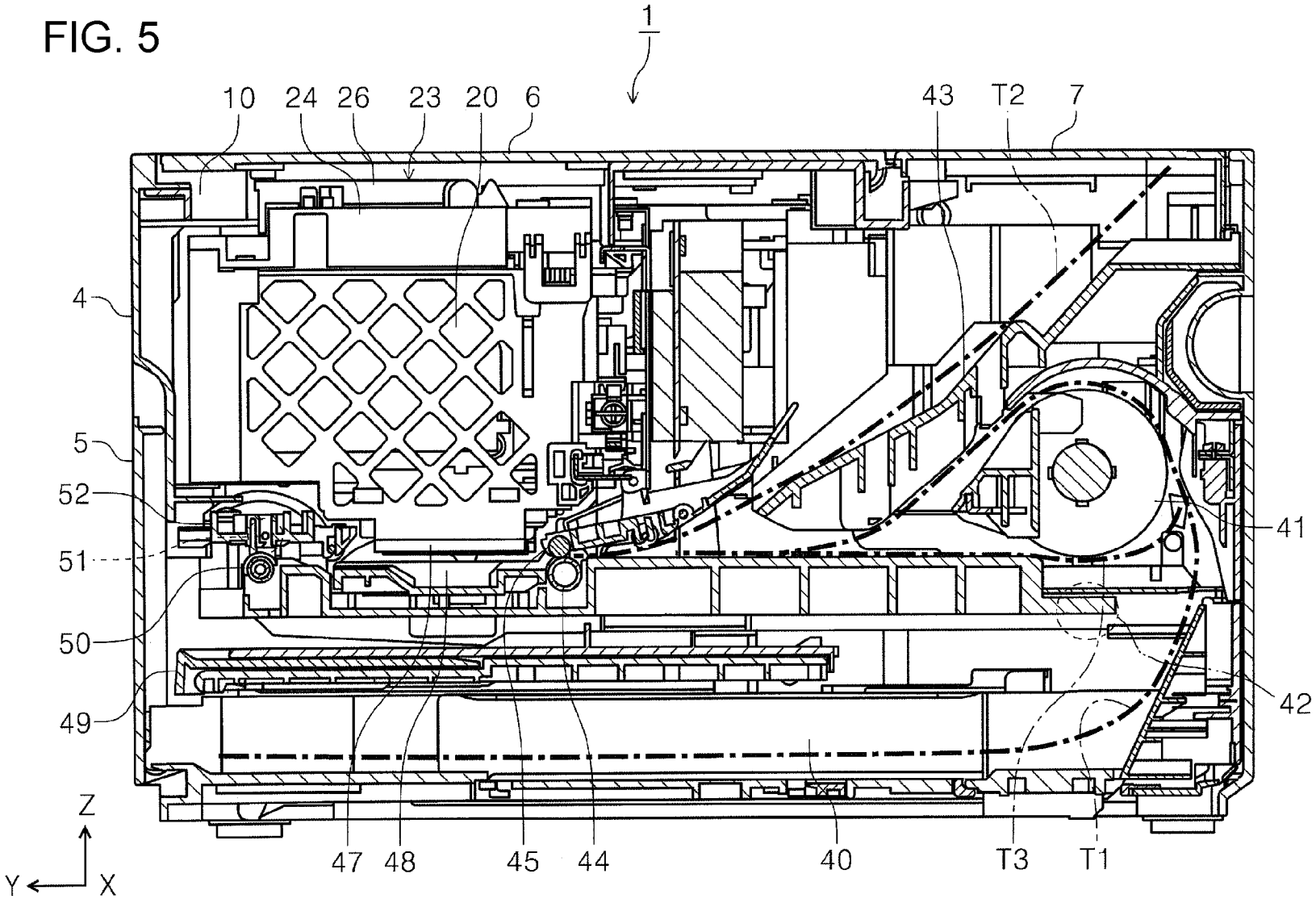
FIG. 5 is a cross-sectional view taken along line V-V in FIG. 1.
Figure 6:
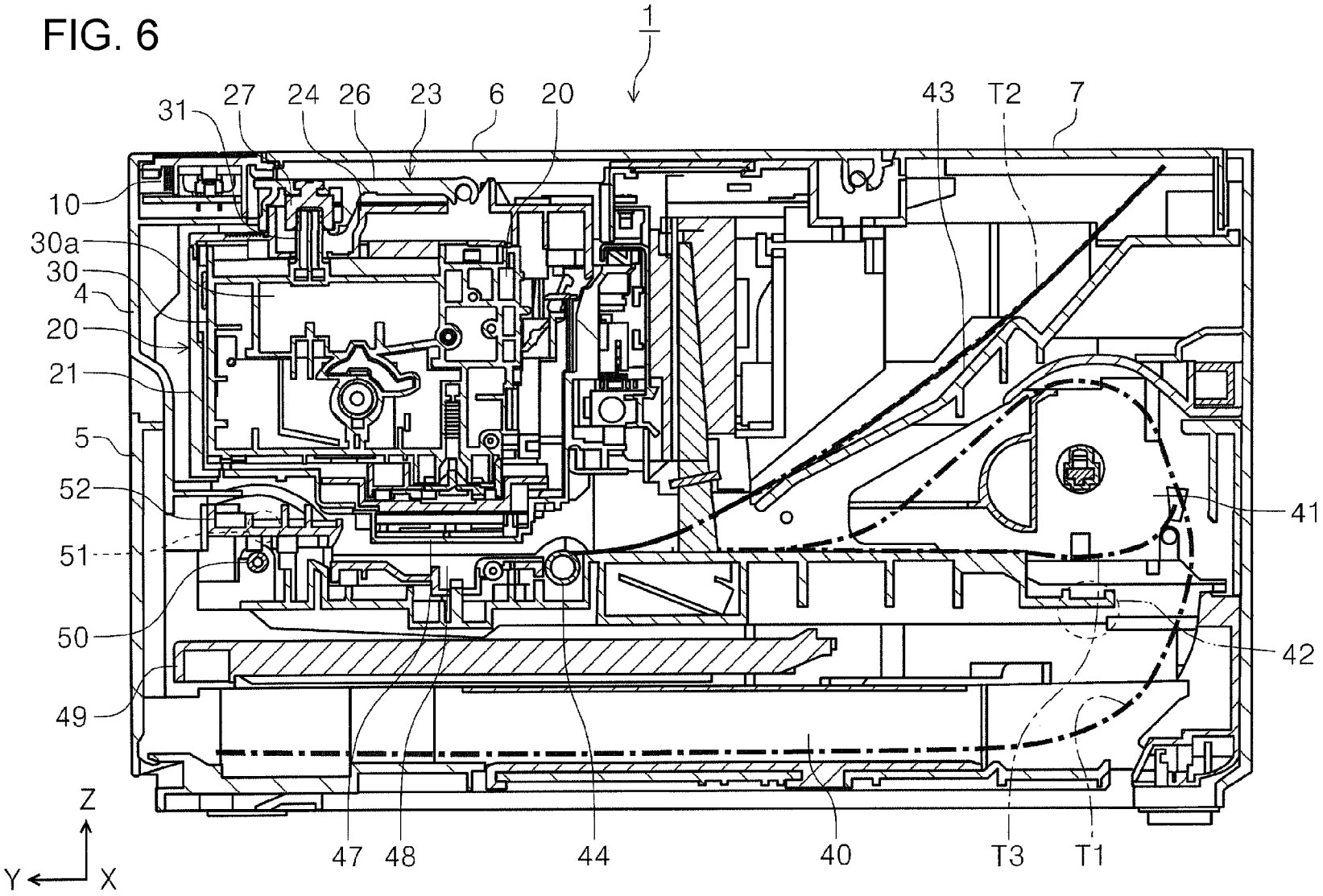
FIG. 6 is a cross-sectional view taken along line VI-VI in FIG. 1.

Hereinafter, with reference to FIGS. 5 and 6, a sheet transport route in the printer 1 is described. The device includes the sheet storage 40 at the bottom. A sheet is taken from the sheet storage 40 by a feeding roller 42 and is sent to a reversing roller 41. The feeding roller 42 is configured to move toward or away from the sheet in the sheet storage 40. The sheet sent from the sheet storage 40 is reversed by the reversing roller 41 and sent to the front side of the device. The reversing roller 41 and the feeding roller 42 are driven by a motor (not illustrated). The symbol T1 indicates a passage of the sheet sent from the sheet storage 40. The symbol T3 indicates a passage of a sheet sent back after recording on a first surface (front surface). In the printer 1, the sheet after recording on the first surface (front surface) is reversed by the reversing roller 41 such that recording is performed on a second surface (rear surface) of the sheet.

The sheet feeder in this embodiment sends sheets from the sheet storage 40 located at the bottom of the device. In addition to this sheet feeder, the device may further include a feeder that feeds sheets from the rear side of the device. Alternatively, the device may include the feeder that feeds sheets from the rear side instead of the feeder that sends sheets from the sheet storage 40 at the bottom of the device. Specifically described, although the upper rear cover 7, which provides the upper rear surface of the device, is not openable in this embodiment, the upper rear cover 7 is made openable to allow a sheet to be inserted from the upper side of the device onto a sheet support 43. Furthermore, a feeding roller (not illustrated) that sends the sheet set on the sheet support 43 may be disposed. In FIG. 5 and FIG. 6, the symbol T2 indicates a passage of the sheet sent from the sheet support 43. This is an example of the mechanism that feeds a sheet from the rear side of the device.

The sheet fed by the above-described feeder is nipped between a transport driving roller 44 and a transport driven roller 45 and sent to a position below a recording head 47, which is one example of a recording unit. The transport driving roller 44 is configured to be driven by a motor (not illustrated) and the transport driven roller 45 is configured to be rotated by rotation of the transport driving roller 44. A direction in which a sheet is transported by the transport driving roller 44 and the transport driven roller 45 is a sheet transport direction for recording, which corresponds to the Y direction, which is a horizontal direction.

The recording head 47 is an ink jet recording head located at the bottom of the carriage 20. The carriage 20 is configured to reciprocate in a sheet width direction (X direction) that intersects the sheet transport direction for recording (Y direction) and discharge ink from the recording head 47 while reciprocating. A support 48 is disposed to face the recording head 47. The support 48 supports the sheet transported by the transport driving roller 44 and the transport driven roller 45 to the downstream side.

The sheet after recording by the recording head 47 is nipped between a discharge driving roller 50 and a discharge driven roller 51, which are located downstream of the recording head 47 in the sheet transport route, and the sheet is discharged to the front side of the device. The discharge driving roller 50 is configured to be driven by a motor (not illustrated) and the discharge driven roller 51 is rotated by rotation of the discharge driving roller 50. The sheet discharged to the front side of the device is received by a paper output tray 49. The paper output tray 49 is slidable between a housing position illustrated in FIGS. 5 and 6 and a protruded position (not illustrated) located frontward of the device from the housing position.

Figure 7:
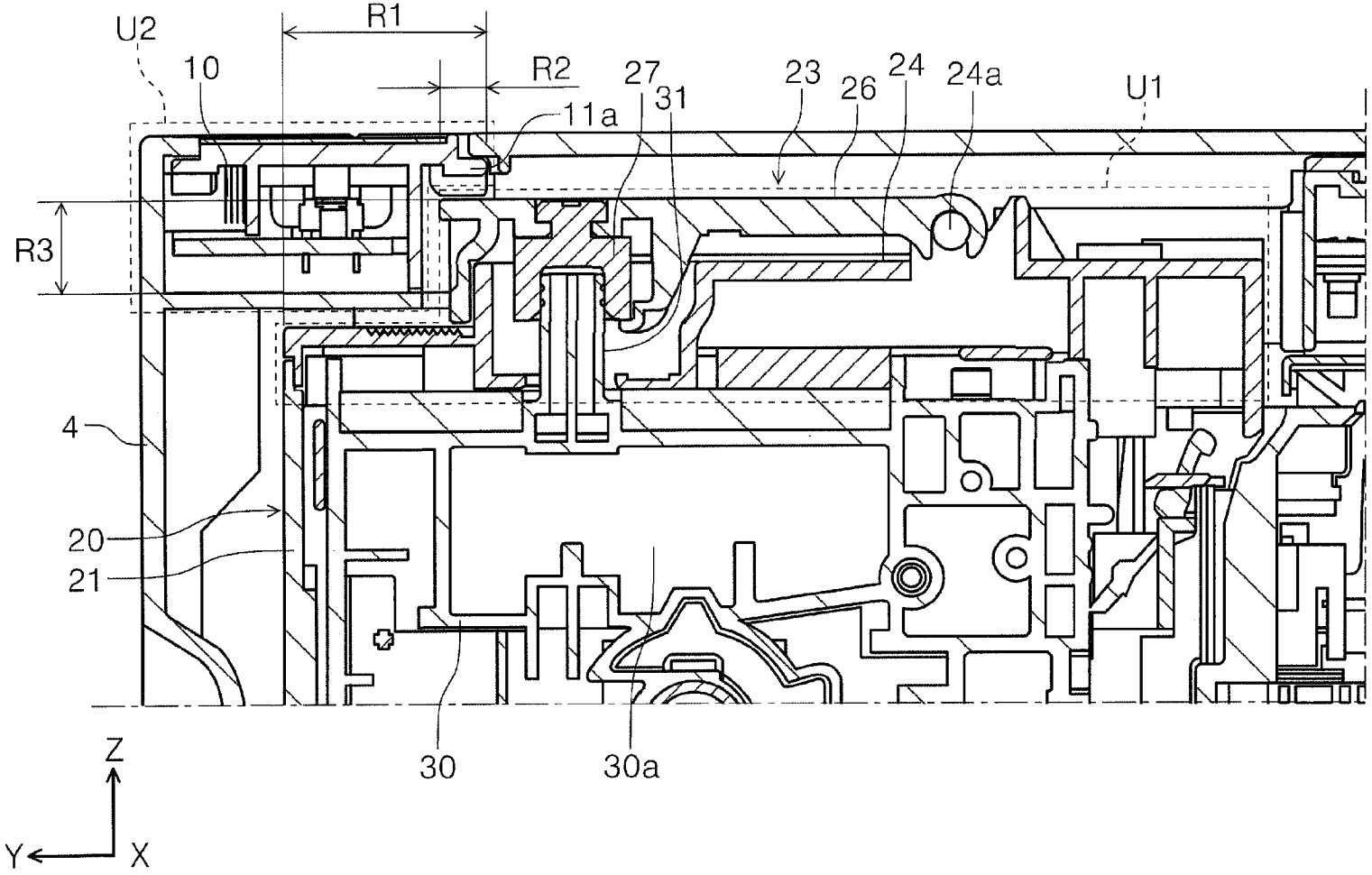
FIG. 7 is a magnified view illustrating a portion in FIG. 6.

Next, the configurations of the carriage 20 and the operation unit 10 are described with reference to FIG. 7 and subsequent figures. As illustrated in FIGS. 5, 6, 7, and 12, the carriage 20 includes an ink tank 30, which is one example of a liquid reservoir that contains ink. The ink is one example of a liquid. The ink is supplied from the ink tank 30 to the recording head 47. In FIGS. 6 and 7, the symbol 30*a* indicates an ink housing space of the ink tank 30.

The ink tank 30 has a fill port 31 (FIGS. 4, 6, and 7) through which ink in an ink bottle (not illustrated) is supplied into (refill) the ink tank 30 by the user. In this embodiment, the ink tank 30 contains one color ink (for example, a black ink) and has one fill port 31. However, the ink tank 30 may contain multiple color inks (for example, black, cyan, magenta, and yellow inks) and have fill ports 31 for the respective color inks, i.e., multiple fill ports 31. Alternatively, in addition to the ink tank 30, one or more detachable cartridges may be disposed. In such a configuration, one or more of the multiple color inks may be supplied (refillable) to the ink tank 30 and the other of the multiple color inks may be supplied by replacing the cartridge(s). In any case, the ink tank 30 has at least one fill port 31.

Figure 11:
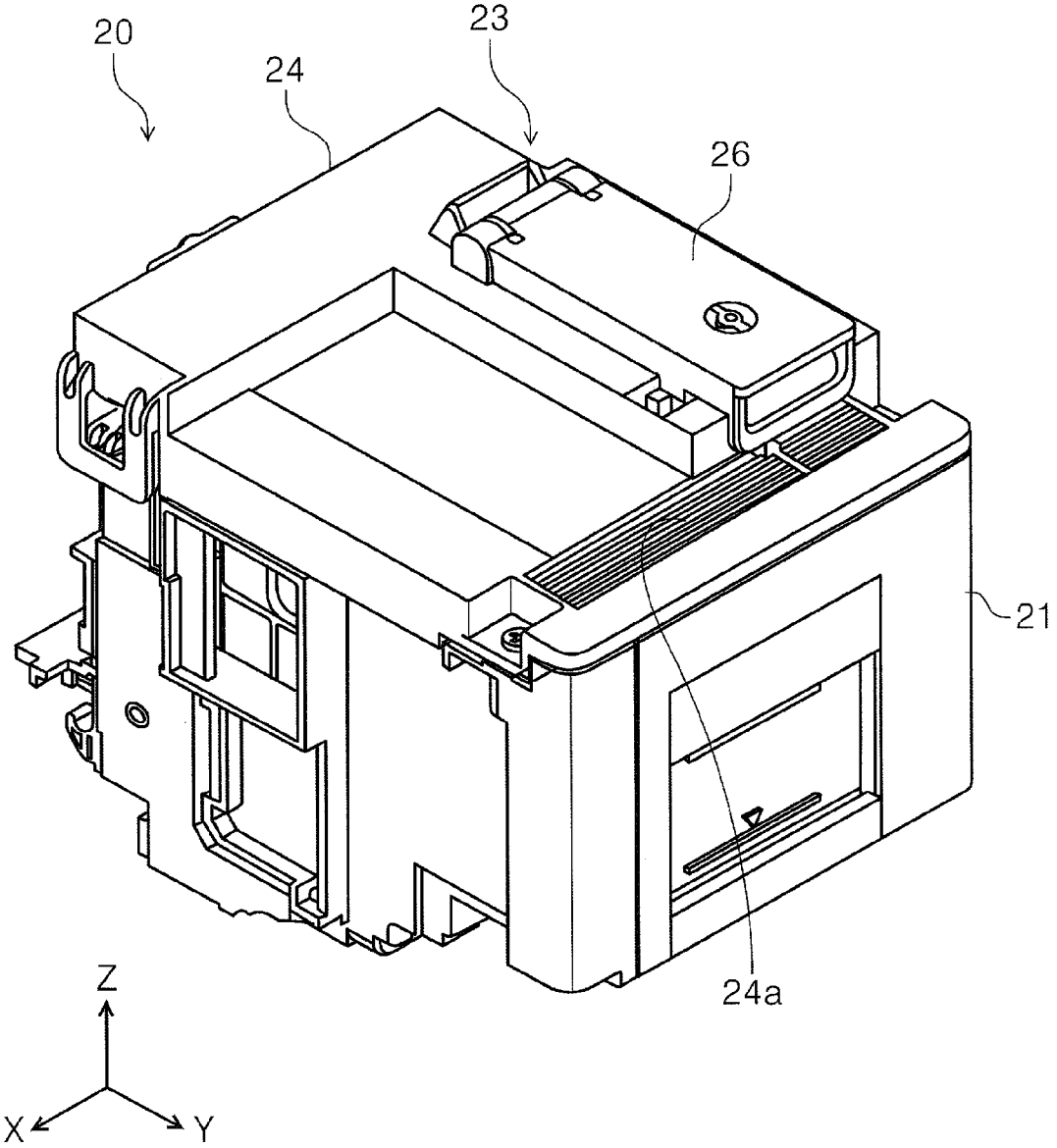
FIG. 11 is a perspective view illustrating the carriage alone viewed obliquely from above.
Figure 12:
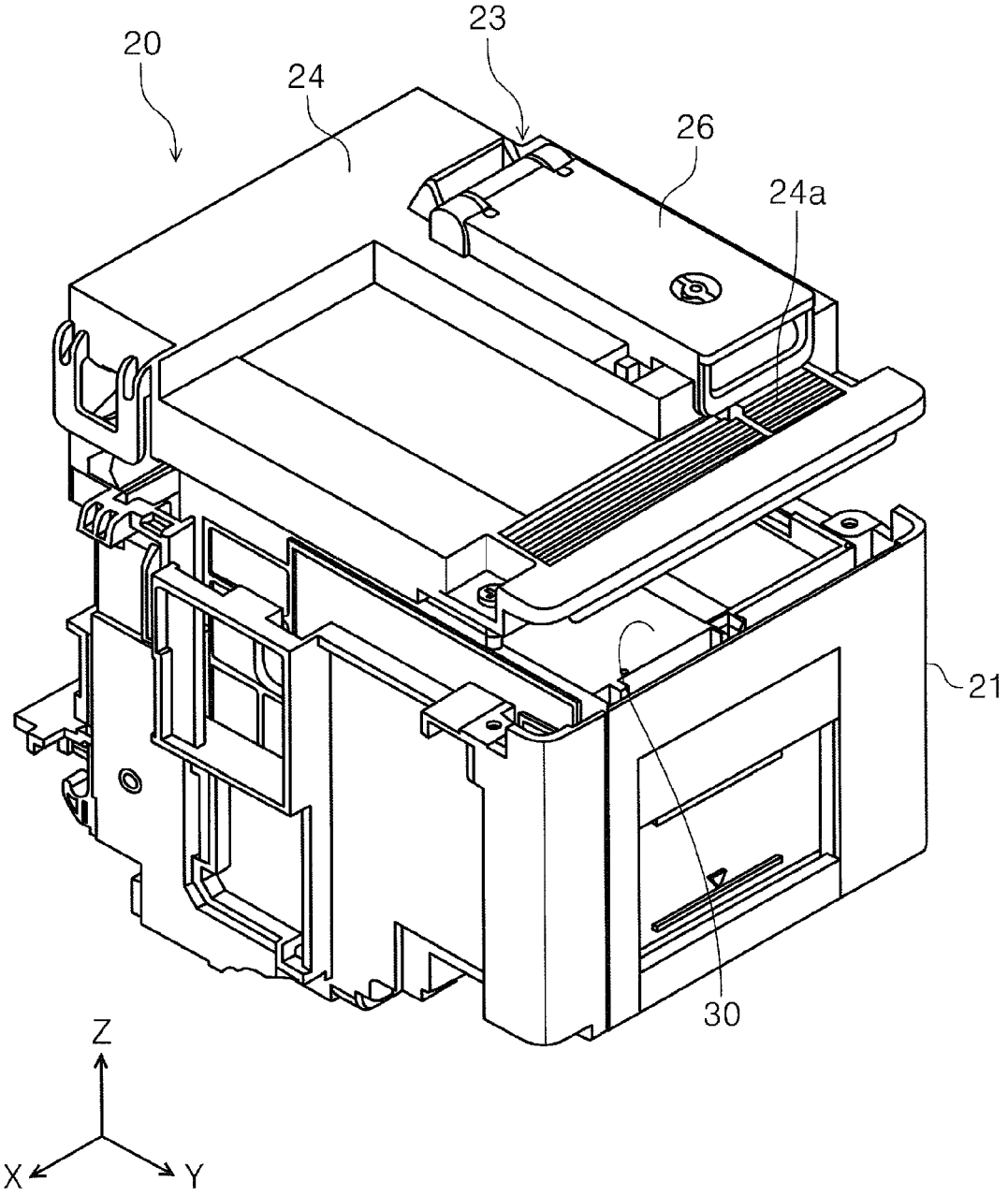
FIG. 12 is an exploded perspective view of the carriage in FIG. 11.

As illustrated in FIGS. 11 and 12, the carriage 20 includes a housing 21. The ink tank 30 is disposed in the housing 21. The carriage 20 includes a fill port unit 23 at the top of the housing 21. The fill port unit 23 includes an upper frame 24, which is one example of a frame member, and a cap lever 26, which is one example of a lever-like member. As illustrated in FIGS. 11 and 12, the fill port unit 23 is detachable from the housing 21.

Figure 3:
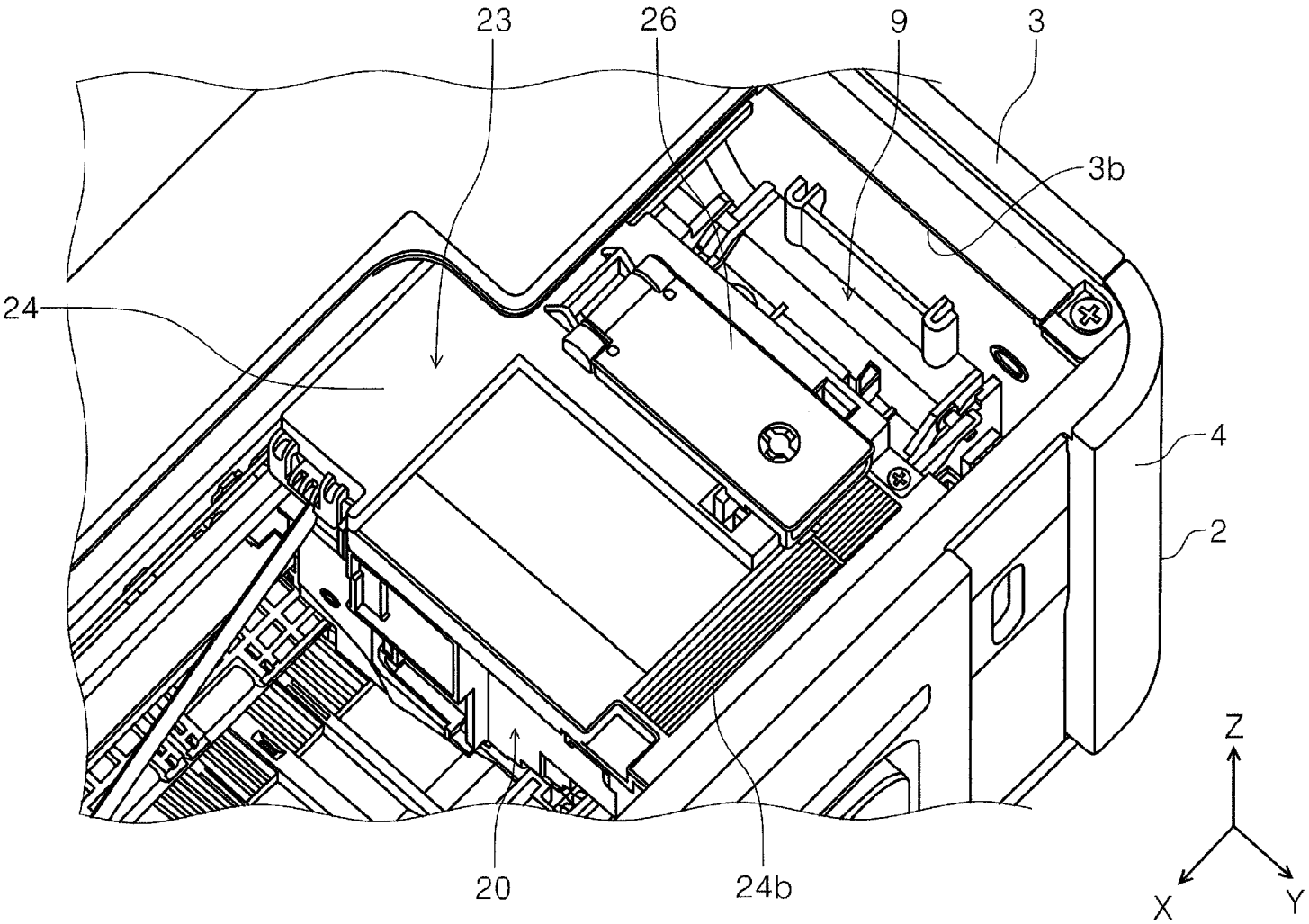
FIG. 3 is a perspective view of a carriage in a home position area.
Figure 4:
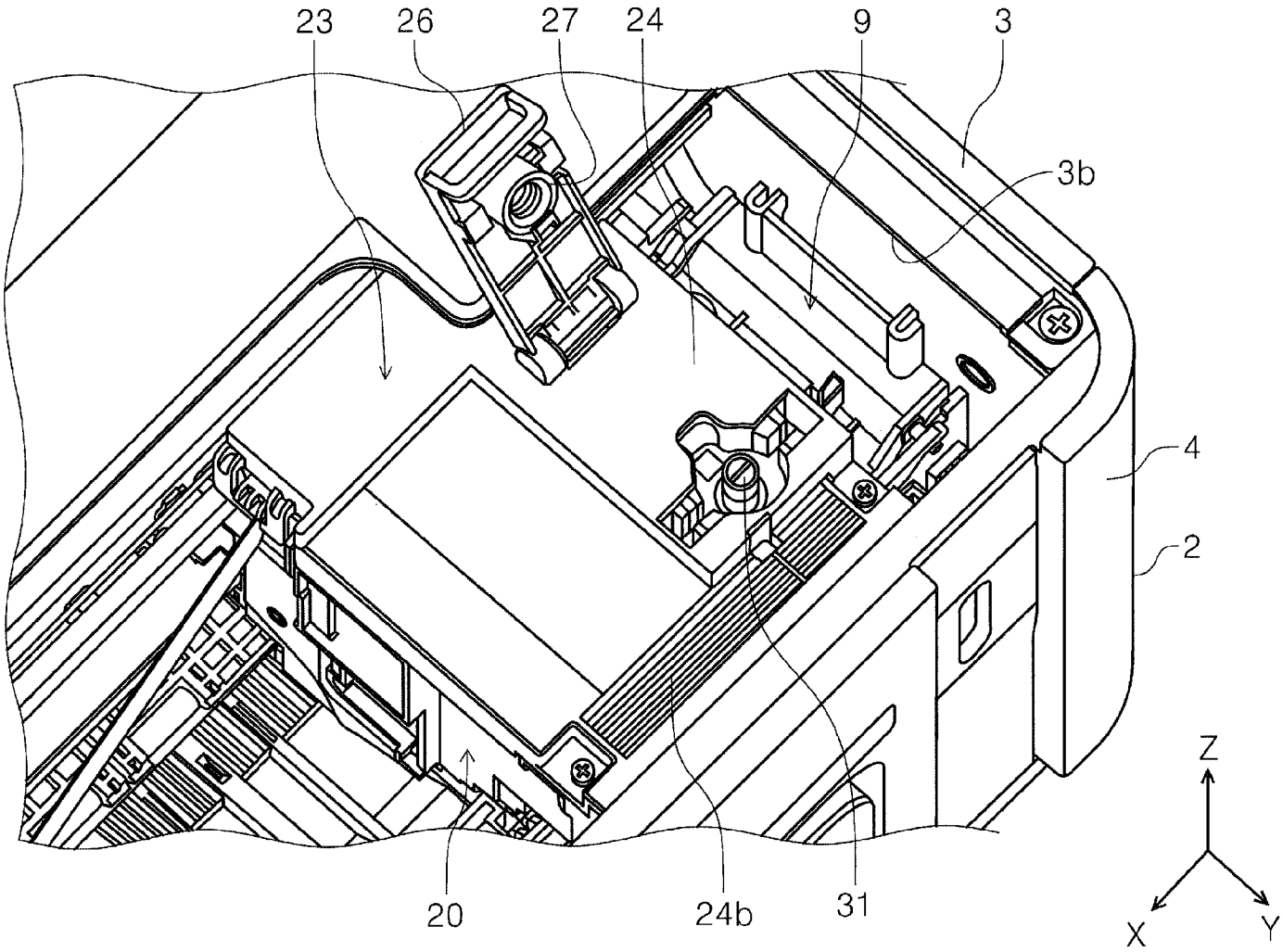
FIG. 4 is a perspective view of the carriage in the home position area.

The fill port unit 23 includes components for open/close operation of the fill port 31. Specifically described, as illustrated in FIGS. 4, 6, and 7, the cap lever 26 includes a cap 27 that closes the fill port 31 and the cap lever is attached to the upper frame 24 in a pivotable manner about a rotation shaft 24*a* (FIG. 7). In other words, the upper frame 24 pivotably supports the cap lever 26. As illustrated in FIGS. 3 and 4, the cap lever 26 pivots to switch its posture between a closing posture in which the cap 27 closes the fill port 31 (FIGS. 3 and 7) and an open posture in which the cap 27 does not close the fill port 31 (FIG. 4).

With this configuration, the cap 27 reliably closes the fill port 31 and the fill port 31 is readily opened or closed by open/close operation of the fill port 31 through the cap lever 26. The above-described fill port unit 23 includes components for open/close operation of the fill port 31 but may include a single component.

FIG. 4 illustrates the cap lever 26 in a maximum open posture. The cap lever 26 in the maximum open posture is open at an angle of more than 90° to keep the cap lever 26 open.

In this embodiment, the cap 27 is formed of an elastic material such as elastomer and has an inner diameter slightly smaller than the outer diameter of the fill port 31. The cap 27 is configured to elastically deform to close the fill port 31. The cap lever 26 remains closed due to a force generated when the cap 27 elastically fits the fill port 31. However, the cap lever 26 may remain closed by using snap-fit connectors. The cap lever 26 may have a protrusion and the upper frame 24 may have a recess to fit the protrusion of the cap lever 26. Furthermore, a locking mechanism that tightly closes the cap lever 26 may be further included.

As illustrated in FIGS. 3 and 4, the upper surface of the upper frame 24 has retaining grooves 24*b* that holds the ink. If the ink is dropped onto the upper frame 24 during the ink supply through the fill port 31, the ink is held in the retaining grooves 24*b*. This reduces the possibility that the ink will scatter when the carriage 20 is in operation. In this embodiment, the retaining grooves 24*b* extend in the X direction but may extend in the Y direction.

Figure 8:
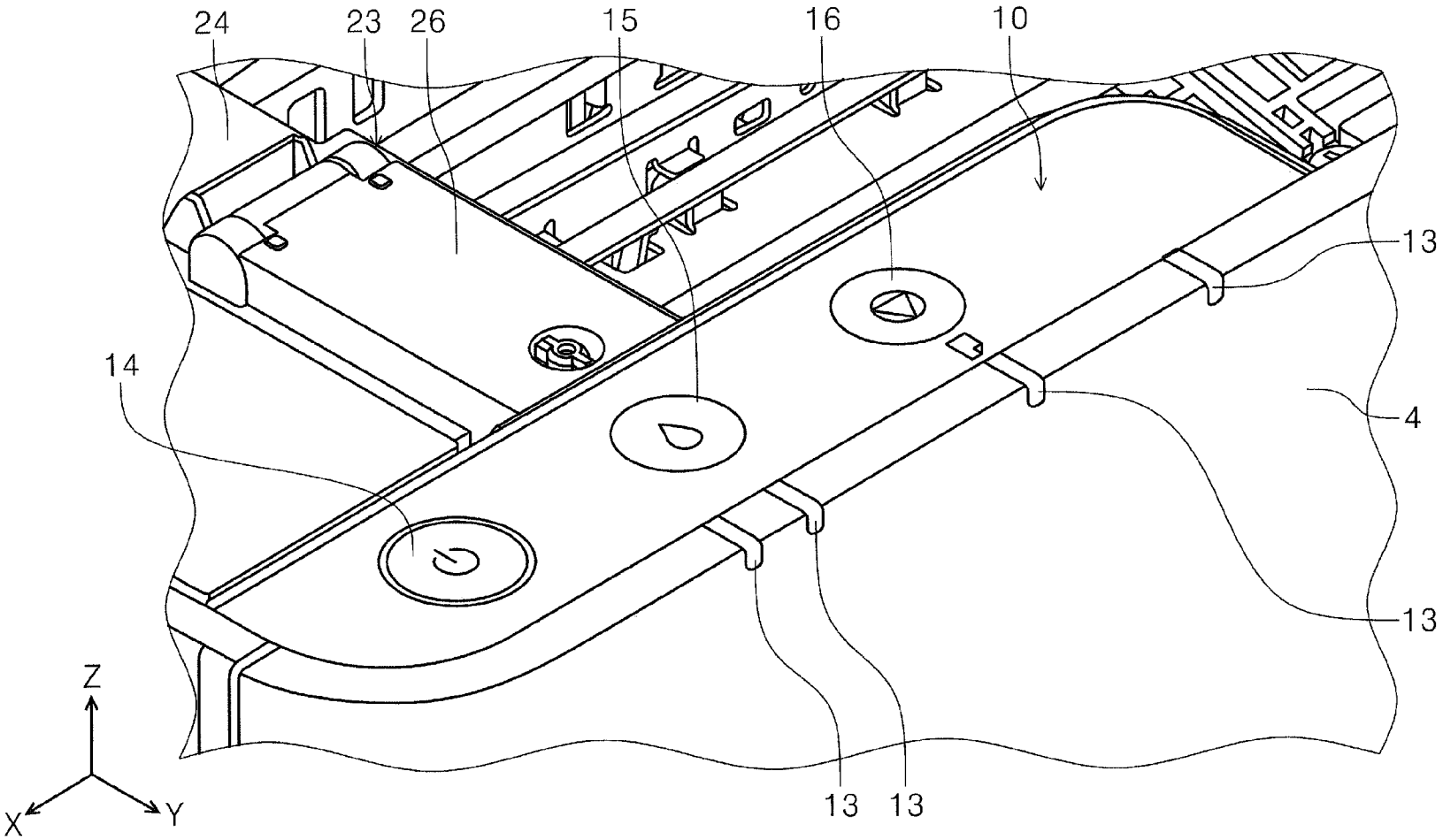
FIG. 8 is a perspective view illustrating an operation unit.
Figure 9:
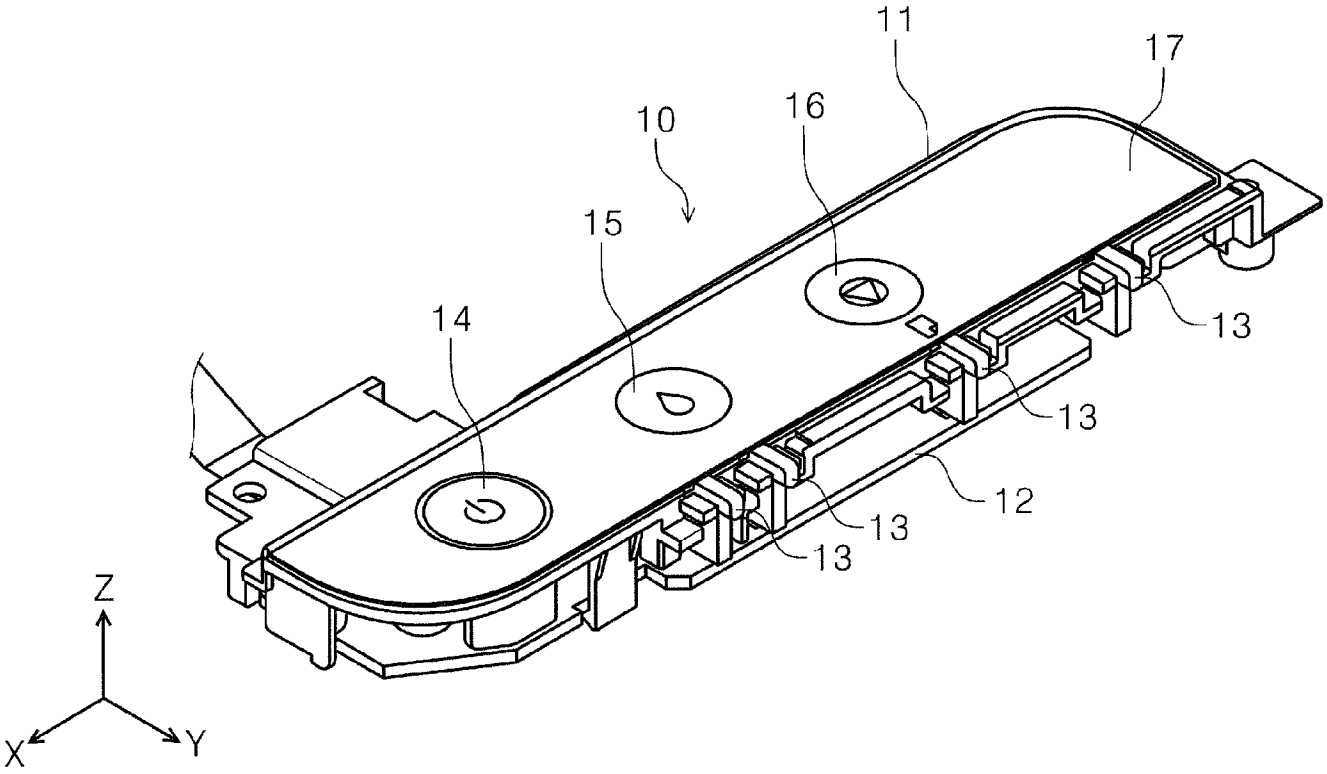
FIG. 9 is a perspective view illustrating an operation unit alone viewed obliquely from above.
Figure 10:
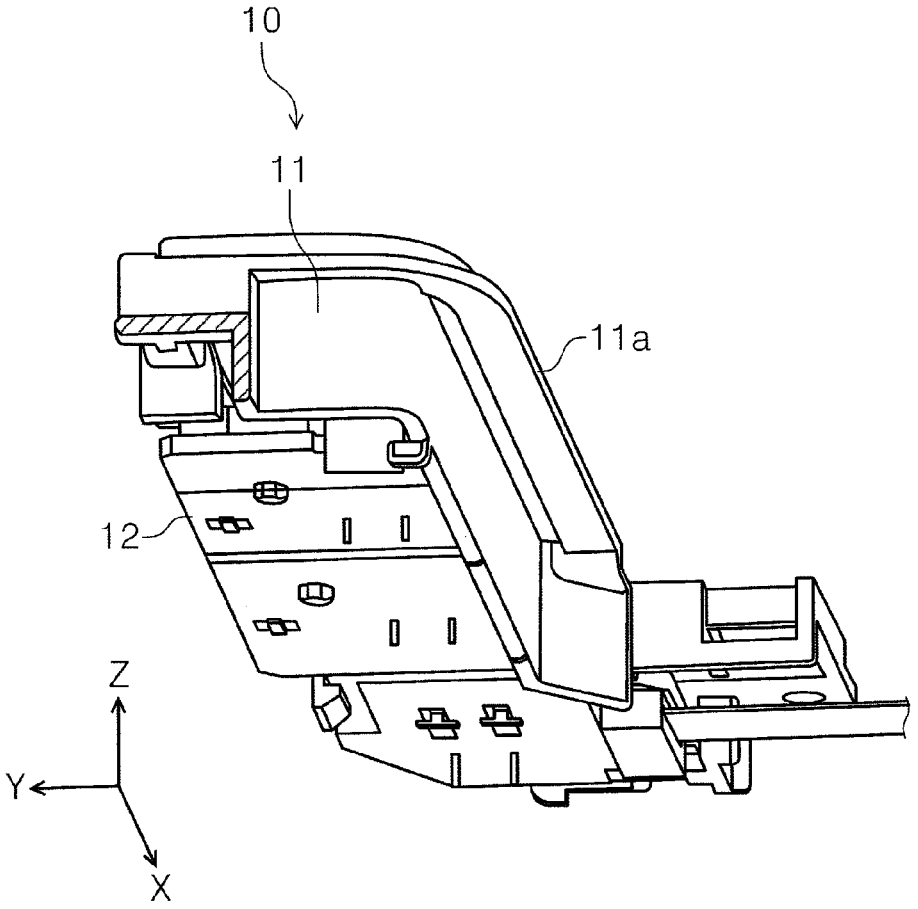
FIG. 10 is a perspective view illustrating the operation unit alone viewed obliquely from below.

Next, the operation unit 10 located adjacent to the movement area of the carriage 20 is described. As illustrated in FIGS. 8, 9, and 10, the operation unit 10 includes three push buttons 14, 15, and 16 in this embodiment. The push buttons 14, 15, and 16 allow the user to switch on and off the printer 1 and to perform various setting operations. The operation unit 10 includes a panel frame 11, a substrate 12 having various circuit components thereon, and four light guide lens (LED displays) 13 that indicate the status of the device. The substrate 12 and the light guide lens 13 are attached to the panel frame 11. A panel sheet 17 is attached to the upper surface of the panel frame 11 to display the tasks operable through the push buttons 14, 15, and 16. The light guide lens 13 guide the light from LEDs (not illustrated), which are light emitter on the substrate 12, toward the outside of the device. The operation unit 10 having such a configuration is attached to the front panel 4.

Figure 14:
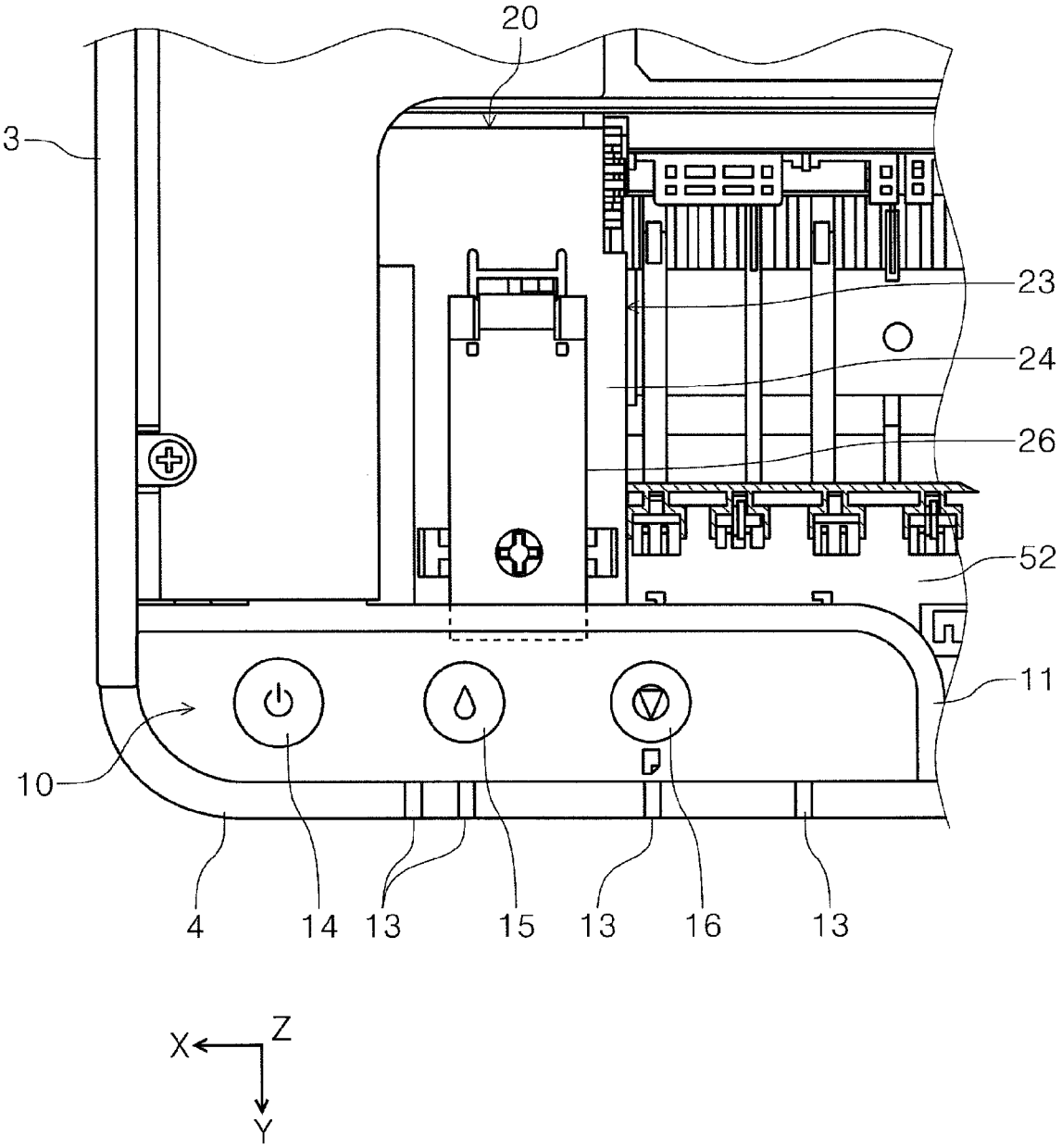
FIG. 14 is a plan view illustrating the carriage and the operation unit. The carriage is positioned at an end away from the home position.

As illustrated in FIG. 10, the panel frame 11 has an overhang 11*a* protruding toward the rear side of the device. When the carriage 20 is moved to the left section of the movement area (area away from the home position area), the front end of the cap lever 26 is located under the overhang 11*a*, as illustrated in FIGS. 7 and 14. Hereinafter, with reference to FIG. 7, the positional relationship between the operation unit 10 and the fill port unit 23 is described.

In FIG. 7, an area surrounded by a broken line with the symbol U1 is an area occupied by the fill port unit 23 when viewed in the sheet width direction (X direction) and an area surrounded by a broken line with the symbol U2 is an area occupied by the operation unit 10 when viewed in the sheet width direction (X direction). As can be seen from FIG. 7, the fill port unit 23 and the operation unit 10 partly overlap in the vertical direction (Z direction) when viewed in the sheet width direction (X direction). Furthermore, when viewed from the front side of the body (Y direction), the fill port unit 23 and the operation unit 10 partly overlap in the vertical direction (Z direction). The symbol R3 indicates a region where the fill port unit 23 and the operation unit 10 overlap in the vertical direction (Z direction). In this configuration, the fill port unit 23 and the operation unit 10 do not entirely overlap in the vertical direction (Z direction), and thus the size of the device in the vertical direction (Z direction) is reduced, preventing the size of the device from increasing.

Furthermore, the fill port unit 23 and the operation unit 10 partly overlap in the device front-rear direction (Y direction) when viewed in the sheet width direction (X direction). The symbol R1 indicates a region where the fill port unit 23 and the operation unit 10 overlap in the device front-rear direction (Y direction). Furthermore, the fill port unit 23 and the operation unit 10 partly overlap in the device front-rear direction (Y direction) when viewed from the upper side (Z direction). In this configuration, the fill port unit 23 and the operation unit 10 do not entirely overlap in the device front-rear direction (Y direction), and thus the size of the device in the device front-rear direction (Y direction) is reduced, preventing the size of the device from increasing.

Furthermore, as can be seen from FIG. 7, the fill port 31 and the operation unit 10 partly overlap in the vertical direction when viewed in the sheet width direction (X direction). With this configuration, the size of the device in the vertical direction (Z direction) is reduced, preventing the size of the device from increasing. The fill port 31 and the operation unit 10 may partly overlap in the device front-rear direction (Y direction) when viewed in the sheet width direction (X direction). With this configuration, the size in the device front-rear direction (Y direction) is reduced, preventing the size of the device from increasing.

Since the fill port unit 23 is included in the carriage 20, it can be said that the carriage 20 and the operation unit 10 partly overlap in the vertical direction (Z direction). It can also be said that the carriage 20 and the operation unit 10 partly overlap in the device front-rear direction (Y direction).

In one embodiment, the upper frame 24 may be eliminated from the fill port unit 23 including components for open/close operation of the fill port 31, for example, and the cap lever 26 may be directly attached to the housing 21 of the carriage 20, for example. In this configuration, as can be understood from FIG. 7, the cap lever 26 included in the fill port unit 23 partly overlaps the operation unit 10 in the vertical direction (Z direction) and in the device front-rear direction (Y direction). The symbol R2 in FIG. 7 indicates a region where the front end of the cap lever 26 and the overhang 11*a* overlap in the device front-rear direction (Y direction).

The operation unit 10 may be located at any position where the fill port unit 23 and the operation unit 10 partly overlap in the device front-rear direction (Y direction) when viewed in the sheet width direction (X direction), other than the position in the present embodiment. For example, the operation unit 10 may be located in any one of areas Q1, Q2, Q3, Q4, and Q5 indicated in FIG. 1. The fill port unit 23 and the operation unit 10 located in any one of the areas partly overlap in the device front-rear direction (Y direction) when viewed in the sheet width direction (X direction).

In this embodiment, the operation unit 10 includes the push buttons 14, 15, and 16 but may further include a display such as a liquid crystal display or may include only a touch panel. Alternatively, the operation unit 10 may include a touch panel and a push button. Furthermore, the operation unit 10 may include only a user interface portion (for example, an LED display) that gives the user visual information or may include only a user interface portion (for example, a speaker) that gives the user audio information.

Figure 13:
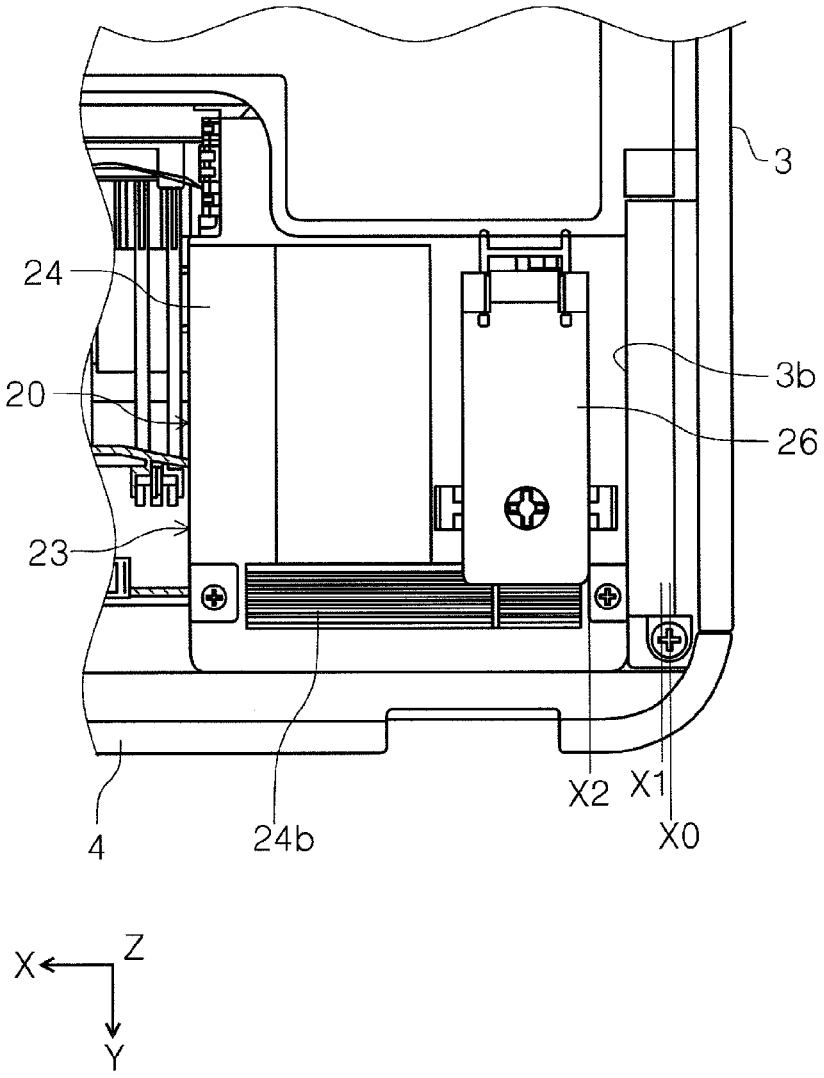
FIG. 13 is a plan view illustrating the carriage in the home position area.
Figure 15:
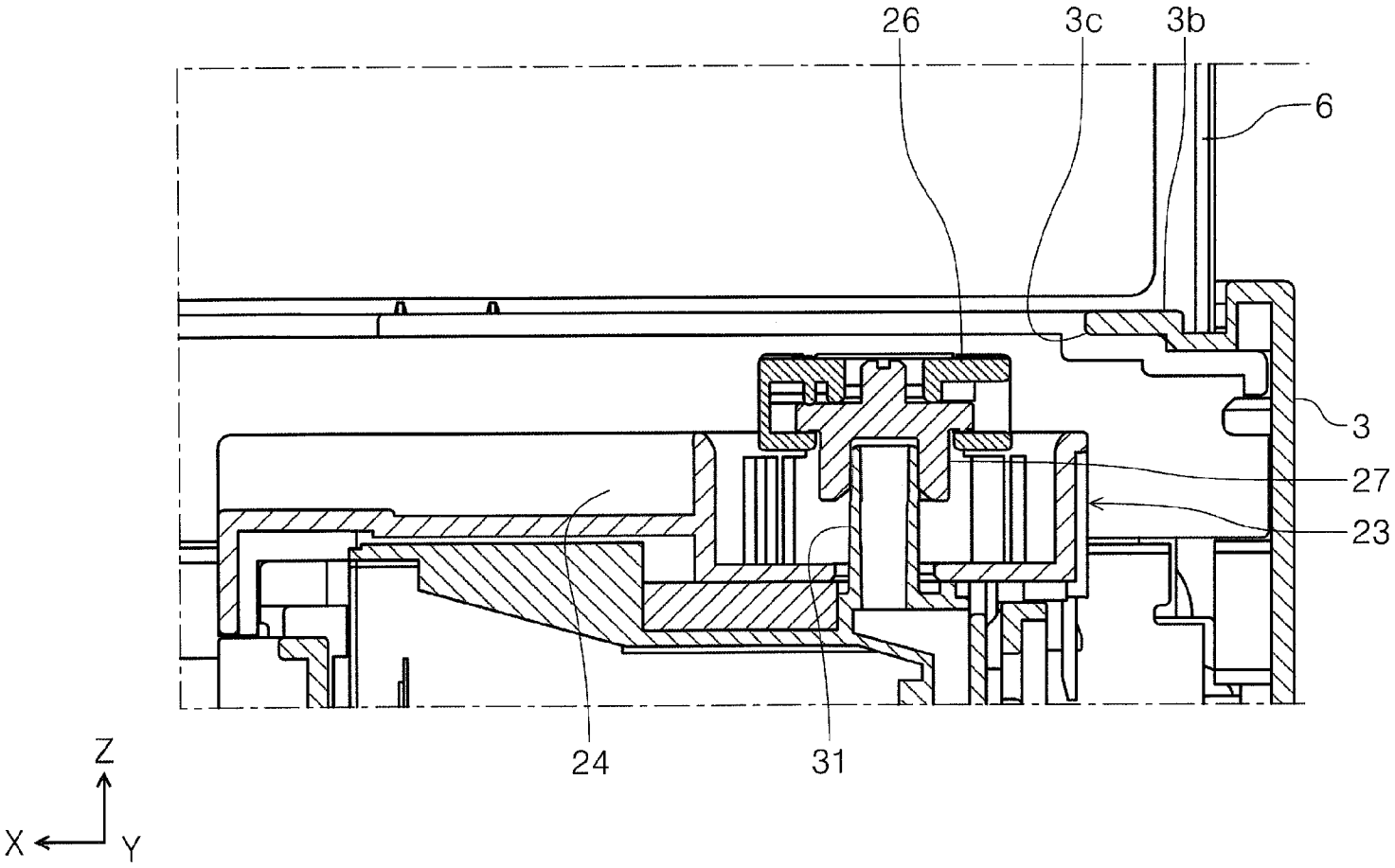
FIG. 15 is a cross-sectional view illustrating a portion of the device. The carriage is positioned in the home position area.

Next, the other components of the printer 1 are described. First, as illustrated in FIGS. 4, 13, and 15, an overhang 3*b* extending from the housing 3 is disposed at the end portion of the movement area of the carriage 20 adjacent to the home position to cover at least a portion of the cap lever 26 from above. In this configuration, when the at least a portion of the cap lever 26 is located under the overhang 3*b*, the cap lever 26 is not unnecessarily operated, i.e., the fill port 31 is not exposed.

Here, as illustrated in FIG. 13, in the home position area of the carriage 20, a position (position of the carriage) where the entire cap lever 26 is away from the position under the overhang 3*b* is a position where the ink is supplied through the fill port 31. This position is referred to as a first position of the carriage 20. The symbol X2 indicates the position of the right end of the cap lever 26 when the carriage 20 is located at the first position. When the right end of the cap lever 26 is located at the position indicated by the symbol X1, or when a portion of the cap lever 26 is located under the overhang 3*b*, the carriage 20 is located at a home position. When the right end of the cap lever 26 is moved from the home position to the right side and arrived at the position indicated by the symbol X0, the carriage 20 is located at a movement limit position adjacent to the home position.

When the carriage 20 is located at the home position, the recording head 47 is engaged with a cap unit 9 (FIGS. 4 and 20) and capped with the cap 9*a* (FIG. 20) included in the cap unit 9. A pump unit 60 is disposed behind the cap unit 9. Activation of the pump unit 60 with the recording head 47 being capped with the cap 9*a* allows the inside of the cap 9*a* to have a negative pressure, allowing the ink to be suctioned through ink discharge nozzle holes (not illustrated) of the recording head 47. While the carriage 20 is located at the home position, the cap unit 9 and the fill port unit 23 overlap in the device front-rear direction (Y direction) and overlap in the device width direction (X direction) when viewed in the vertical direction.

Figure 16:
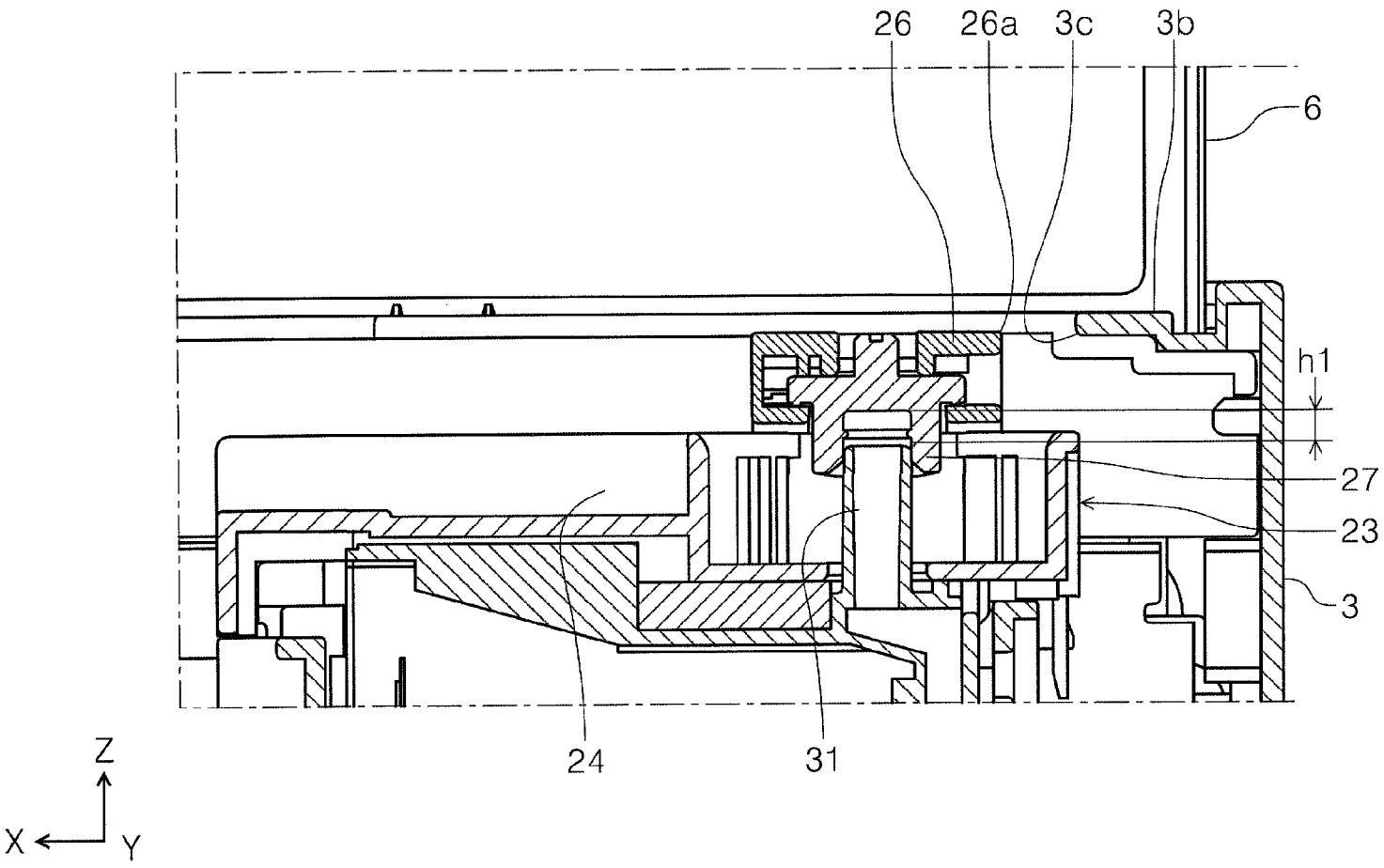
FIG. 16 is a cross-sectional view illustrating a portion of the device. The carriage is positioned in the home position area.

If the carriage 20 at the first position is moved toward the home position with the cap lever 26 being open (in a posture other than the closing posture), the cap lever 26 comes in contact with the overhang 3*b*, damaging the cap lever 26 or the overhang 3*b*. FIG. 16 illustrates a half-open cap lever 26. The dimension h1 indicates an uplifted amount of the cap lever 26. The term "half-open" herein refers to a state in which the cap 27 is placed on the fill port 31 with the own weight thereon (including the weight of the cap lever 26). In this embodiment, to avoid the damage, the lower corner of the overhang 3*b* has a rounded surface (symbol 3*c*) that serves as a guide portion that guides the cap lever 26 to a position under the overhang 3*b* when a corner 26*a* of the cap lever 26 comes in contact with the lower corner. The rounded surface eliminates or reduces the above-described problem. In this embodiment, the cap 27 substantially completely closes the fill port 31 when the cap lever 26 is guided to the position under the overhang 3*b*.

Figure 17:
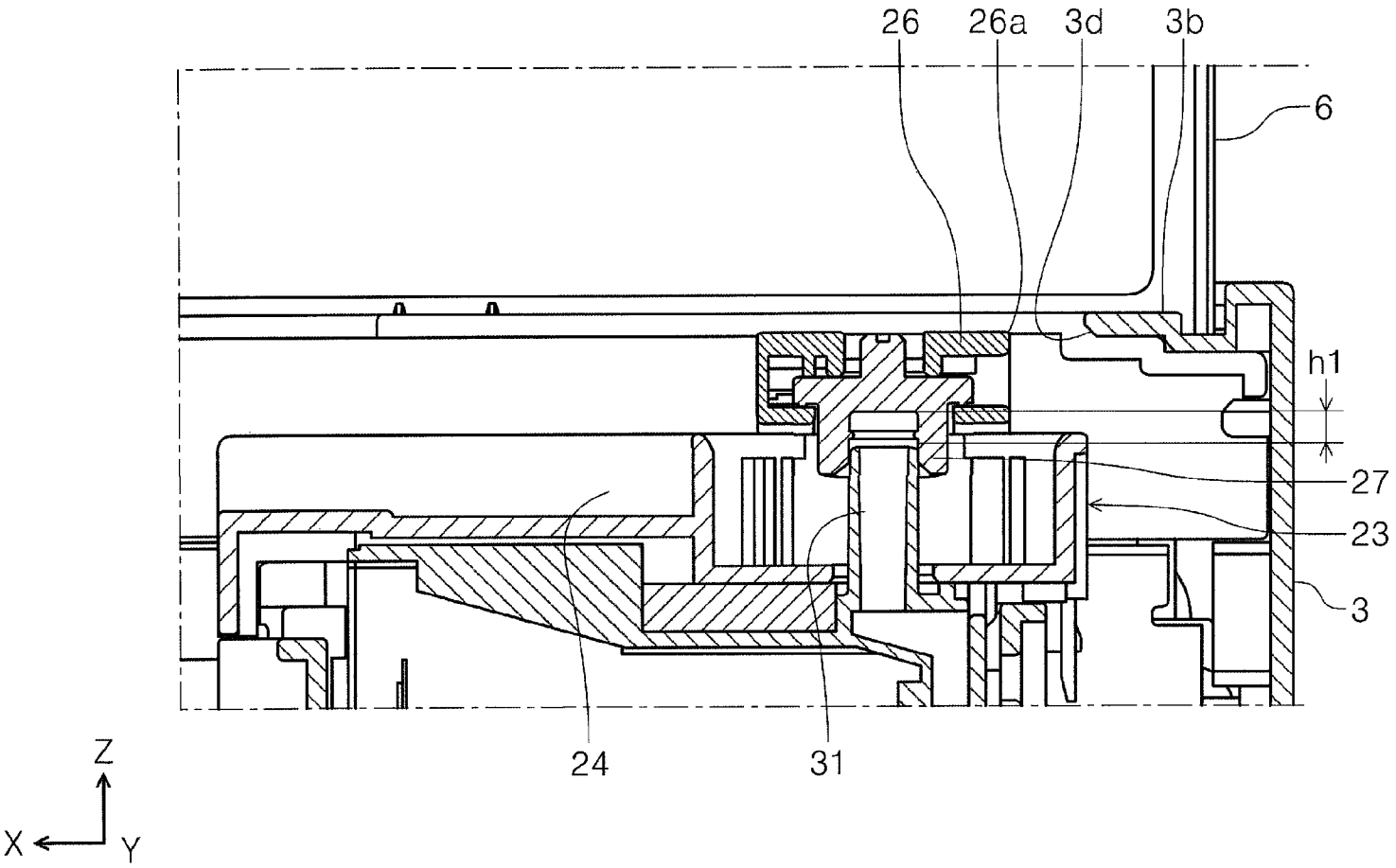
FIG. 17 is a cross-sectional view illustrating a portion of the device. The carriage is positioned in the home position area.
Figure 18:
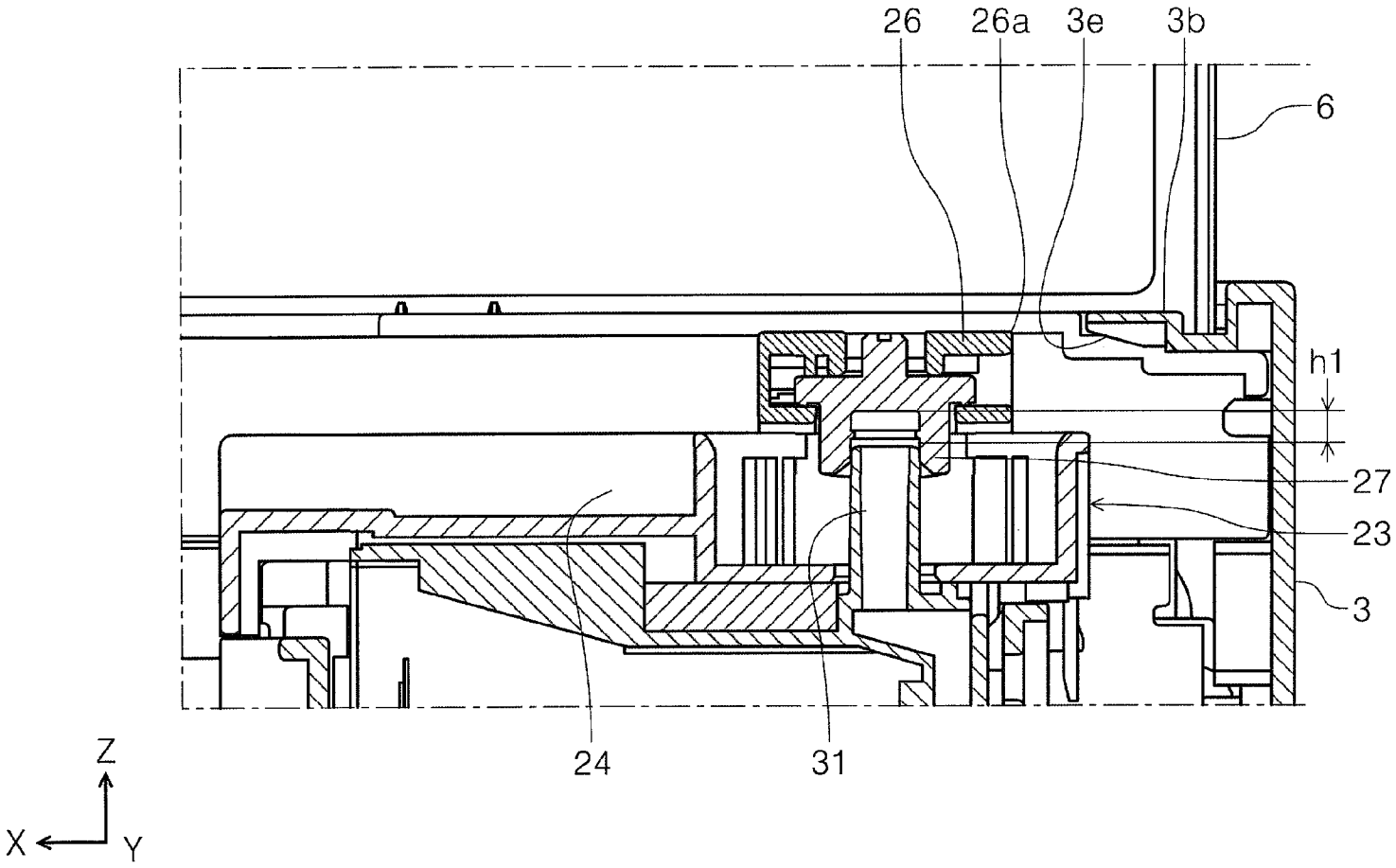
FIG. 18 is a cross-sectional view illustrating a portion of the device. The carriage is positioned in the home position area.
Figure 19:
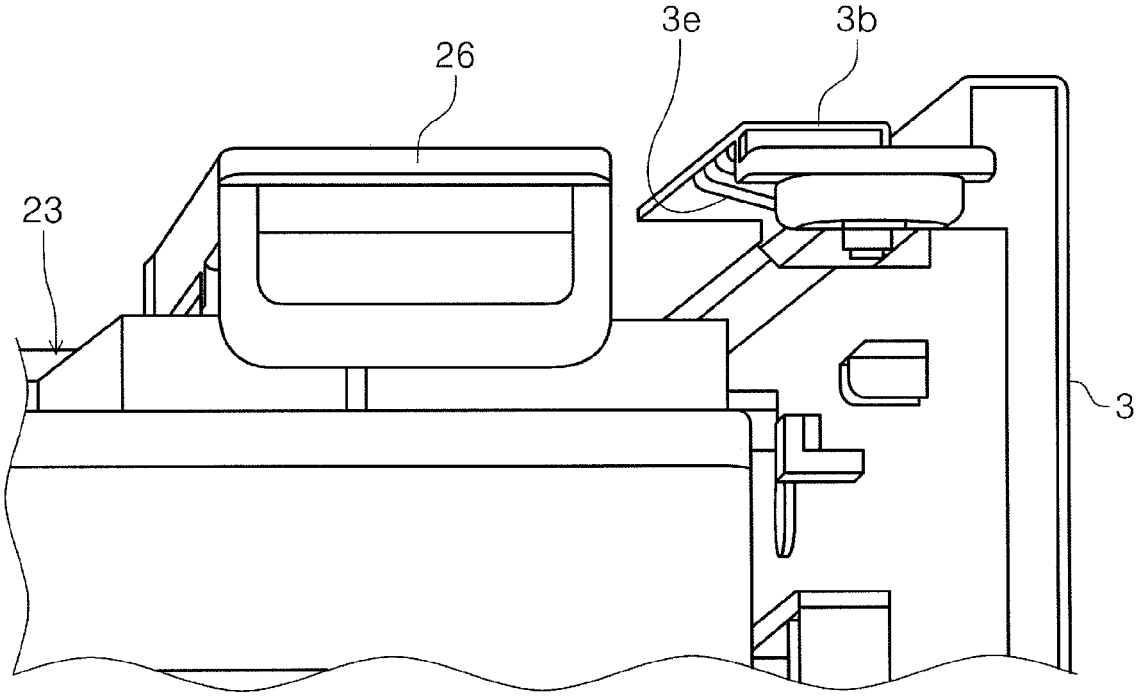
FIG. 19 is a perspective view illustrating an overhang. The carriage is positioned in the home position area.

The lower corner of the overhang 3*b* may have a chamfered surface (symbol 3*d*) as illustrated in FIG. 17. The chamfered surface 3*d* serves as the guide portion. An inclination rib 3*e* may be disposed under the overhang 3*b* as illustrated in FIGS. 18 and 19. The inclination rib 3*e* serves as the guide portion.

Next, the positional relationship between the fill port unit 23 and the other components is described. First, as can be seen from FIG. 6, the fill port unit 23 and a roller support 52, which supports the discharge driven roller 51, partly overlap in the device front-rear direction (Y direction), reducing the size of the device in the device front-rear direction (Y direction).

As illustrated in FIG. 20, the upper surface of the roller support 52 has multiple guide grooves 52*a* that guide ink in the X direction. Although not illustrated, the guide grooves 52*a* slope down toward the right side of the device, i.e., toward the home position. This allows the ink dropped in the guide grooves 52*a* during the ink supply through the fill port 31 to be guided toward the right side of the device or the home position. An ink absorber 53 that absorbs ink is disposed adjacent to the ink guide end of the guide groove 52*a* to reduce the possibility that the inside of the device will get dirt or damaged by the ink. In this embodiment, the guide grooves 52*a* slope down to the right side of the device but may extend horizontally. Furthermore, the guide grooves 52*a* extend in the X direction in this embodiment but may extend in the Y direction. Furthermore, the guide grooves 52*a* are provided in the upper surface of the roller support 52 in this embodiment but a separate member including the guide grooves 52*a* may be disposed above the roller support 52. When the carriage 20 is located at the home position, the ink absorber 53 and the fill port unit 23 partly overlap in the device front-rear direction (Y direction) and the device width direction (X direction) when viewed in the vertical direction.

The imaginary line with the symbol P1 indicates an X-Y plane area occupied by a sheet that is supported by the open front cover 5 and the sheet storage 40 (FIGS. 5 and 6), particularly an X-Y plane area occupied by a largest possible size sheet. The occupied area P1 overlaps the movement area of the carriage 20 when viewed in the vertical direction, i.e., overlaps the fill port unit 23 in the X direction and the Y direction. The occupied area P1 also overlaps the roller support 52 in the X direction and the Y direction when viewed in the vertical direction. Furthermore, the occupied area P1 overlaps a portion of the operation unit 10 in the X direction and the Y direction when viewed in the vertical direction. This configuration reduces the size of the device.

Figure 21:
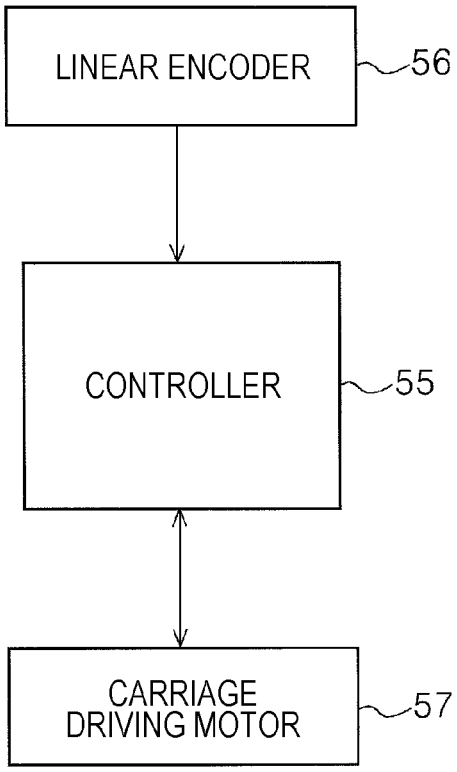
FIG. 21 is a block diagram indicating a carriage control system.
Figure 22:
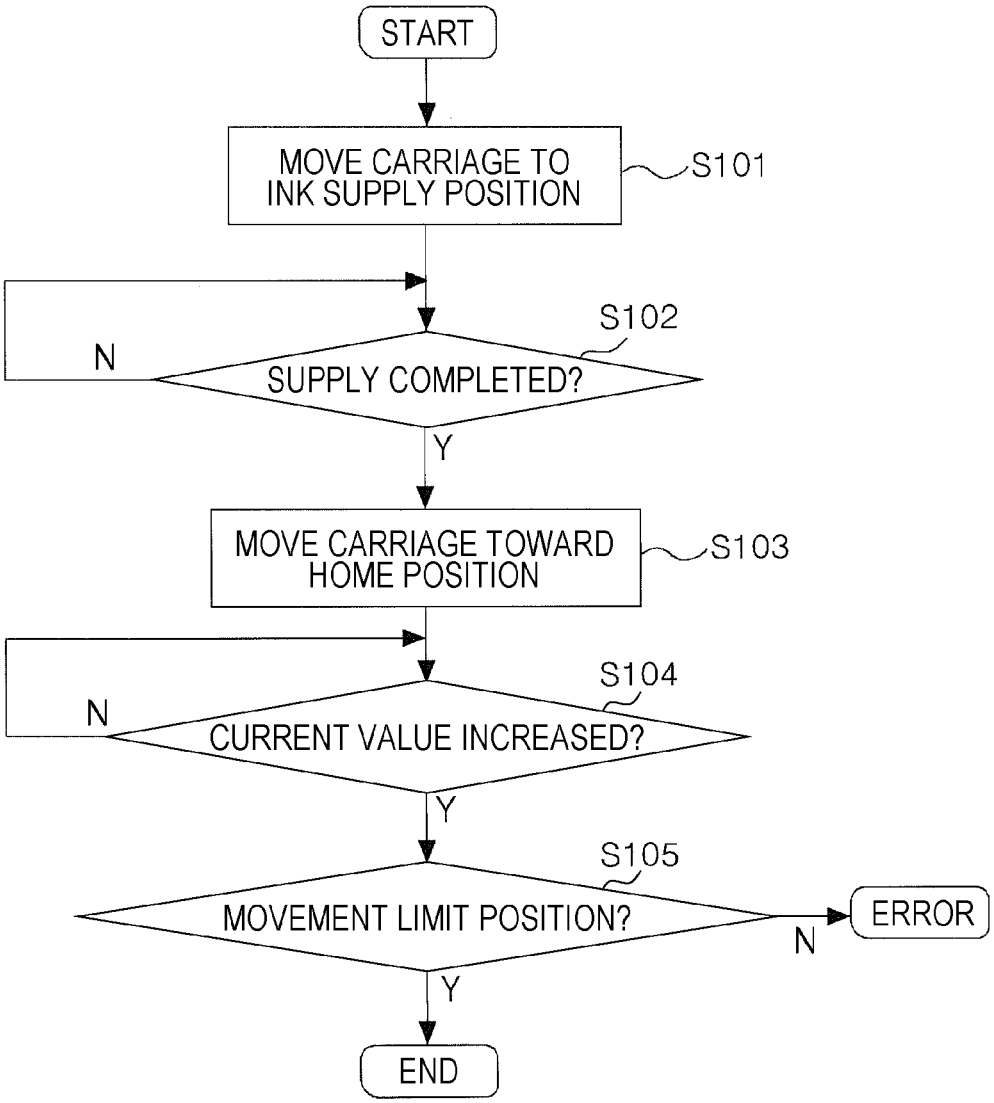
FIG. 22 is a flow chart indicating carriage control for ink supply.

Next, with reference to FIGS. 21 and 22, control of the carriage 20 for ink supply is described. FIG. 21 indicates a control system for the carriage 20. A controller 55, which is one example of a control unit, receives a detection signal from a linear encoder 56. The linear encoder 56 is a sensor configured to detect the position of the carriage 20 and a relative position of the carriage 20 is determined, after the reference position is detected. The controller 55 is configured to control a carriage driving motor 57, which is a power source of the carriage 20, based on the detection signals from the linear encoder 56. The controller 55 includes a motor driver that controls the carriage driving motor 57.

The operation to detect the reference position of the carriage 20 is performed when the printer 1 is powered on, for example. More specifically described, when the printer 1 is powered on, the controller 55 moves the carriage 20 to the movement limit position adjacent to the home position. When the carriage 20 arrives at the movement limit position adjacent to the home position, the driving current value of the carriage driving motor 57 increases. The controller 55 detects the increase and sets the position of the carriage 20 as a reference position. Then, the controller 55 determines the relative position of the carriage 20 relative to the reference position based on the detection signal from the linear encoder 56 to perceive the position of the carriage 20.

In FIG. 22, upon receiving an ink supply instruction from the user, the controller 55 moves the carriages 20 to the position indicated in FIG. 13, i.e., the first position (hereinafter may be referred to as an "ink supply position") where the cap lever 26 is located away from the overhang 3*b* (Step S101). This is a carriage stop mode, which is one of control modes executed by the controller 55. In this state, the user supplies ink through the fill port 31 (FIG. 4). Next, upon receiving a supply completion instruction from the user (Yes at Step S102), the controller 55 moves the carriages 20 toward the movement limit position adjacent to the home position (Step S103).

If the carriage 20 at the ink supply position is moved to the movement limit position adjacent to the home position with the cap lever 26 being open, the cap lever 26 comes in contact with the overhang 3*b* as can be seen from FIG. 4. The controller 55 uses this positional relationship to determine whether the motor current value increased at the movement limit position (Steps S104 and S105). If the carriage 20 is located at the movement limit position when the motor current value increased (Yes at Step S105), the controller 55 determines that the cap lever 26 is completely closed, and then performs normal termination. If the carriage 20 is not located at the movement limit position when the motor current value increased (No at the step S105), the controller 55 determines that the cap lever 26 is not closed and has come in contact with the overhang 3*b*, and then performs abnormal termination. At this time, the controller 55 may display an alert message on a printer driver or may illuminate or blink the light guide lens 13 (FIG. 8), which indicate device status, to notify an error.

As described above, when the controller 55 returns from the carriage stop mode, the controller 55 moves the carriage 20 at the ink supply position toward the movement limit position adjacent to the home position and determines whether the cap lever 26 is open or closed based on the position where the carriage 20 stopped. This configuration provides the following advantages. Specifically described, if the cap lever 26 is kept opened after the ink supply to the ink tank 30, defects such as ink evaporation and ink leakage through the fill port 31 may be caused. This problem is avoided by the above-described control that determines whether the cap lever 26 is closed or open. In addition, this configuration does not require a separate sensor or the like to determine whether the cap lever 26 is open or closed, preventing the cost of the device from increasing.

If the cap lever 26 is in a half-opening posture closest to the closing posture, which is one example of incomplete closing postures of the cap lever 26 (FIG. 16), i.e., if the cap 27 is located on the fill port 31 with its own weight thereon (including the weight of the cap lever 26), the cap lever 26 is guided by the guide portion (rounded surface 3*c* in FIG. 16), which is the lower corner of the overhang 3*b*, to the position under the overhang 3*b*, allowing the cap 27 to substantially completely close the fill port 31. Thus, in this embodiment, the cap lever 26 in this posture is not in the "posture other than the closing posture" that allows the cap lever 26 to come in contact with the overhang 3*b*.

The technical scope of the invention is not limited to the above-described embodiment. Any modifications may be suitably added to the invention without departing from the scope of the invention understood from the claims and the description. Such modifications are in the technical scope of the invention.

The entire disclosure of Japanese Patent Application No. 2018-056526, filed Mar. 23, 2018 is expressly incorporated by reference herein.

What is claimed is:

1. A recording device comprising:

a recording unit configured to eject a liquid onto a medium to record;

a carriage including the recording unit at a bottom thereof and configured to move along a movement path in an X direction corresponding to a medium width direction that intersects a Y direction corresponding to a medium transport direction in which a medium is transported while the recording unit is recording;

a liquid reservoir located in the carriage at a position above the recording unit, configured to contain a liquid, and having a fill port through which the liquid is supplied;

a fill port unit located in the carriage at a position above the liquid reservoir and including a component for open/close operation of the fill port; and an operation unit through which the device is operated, wherein the operation unit extends over the movement path such that the fill port unit and the operation unit partly overlap in a vertical direction when viewed in the X direction when the carriage passes under the operation unit.

2. The recording device according to claim 1, wherein the fill port unit includes a pivotable lever-like member having a cap configured to close the fill port and a frame member supporting the lever-like member, and the lever-like member is configured to pivot to switch its posture between a closing posture in which the cap closes the fill port and an open posture in which the cap does not close the fill port.

3. The recording device according to claim 2, wherein an overhang configured to cover at least a portion of the lever-like member from above is disposed at an end portion of a movement area of the carriage adjacent to a home position, and the overhang includes a guide portion that guides the lever-like member to a position under the overhang.

4. The recording device according to claim 2, wherein the frame member has an upper surface having a plurality of grooves that hold a liquid.

5. The recording device according to claim 2, wherein an overhang configured to cover at least a portion of the lever-like member from above is disposed at an end portion of a movement area of the carriage adjacent to a home position, a control unit that controls the carriage is configured to execute a carriage stop mode in which the carriage stops at a first position where the lever-like member is located away from the overhang, the lever-like member in a posture other than the closing posture comes in contact with the overhang when the carriage moves from the first position toward a movement limit position adjacent to the home position, and the control unit is configured to move the carriage from the first position toward the movement limit position when returns from the carriage stop mode and is configured to determine whether the lever-like member is open or closed based on a position where the carriage stopped.

6. The recording device according to claim 1, further comprising, at a downstream side of the recording unit in a medium transport route, a discharge driving roller configured to be rotated and a discharge driven roller opposed to the discharge driving roller and configured to be rotated by rotation of the discharge driving roller, wherein the fill port unit and a roller support supporting the discharge driven roller partly overlap in a device front-rear direction that is parallel to the medium transport direction, when viewed in the X direction.

7. The recording device according to claim 6, wherein the roller support has an upper surface having a guide groove that guides the liquid in a predetermined direction, and a liquid absorber configured to absorb the liquid is disposed adjacent to an ink guide end of the guide groove.

* * * * *